US012281856B2

(12) United States Patent
Akaiwa et al.

(10) Patent No.: US 12,281,856 B2
(45) Date of Patent: Apr. 22, 2025

(54) HEAT EXCHANGER AND AIR-CONDITIONING APPARATUS

(71) Applicant: Mitsubishi Electric Corporation, Tokyo (JP)

(72) Inventors: Ryota Akaiwa, Tokyo (JP); Yoji Onaka, Tokyo (JP); Yohei Kato, Tokyo (JP); Norihiro Yoneda, Tokyo (JP); Satomi Asai, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 375 days.

(21) Appl. No.: 17/767,057

(22) PCT Filed: Nov. 28, 2019

(86) PCT No.: PCT/JP2019/046566
§ 371 (c)(1),
(2) Date: Apr. 7, 2022

(87) PCT Pub. No.: WO2021/106142
PCT Pub. Date: Jun. 3, 2021

(65) Prior Publication Data

US 2022/0381515 A1 Dec. 1, 2022

(51) Int. Cl.
*F28F 9/02* (2006.01)
*F25B 39/02* (2006.01)
(Continued)

(52) U.S. Cl.
CPC ..... *F28D 7/16* (2013.01); *F25B 39/02* (2013.01); *F28F 9/02* (2013.01)

(58) Field of Classification Search
CPC ..... F25B 39/02; F25B 39/028; F28D 1/053; F28F 9/0202; F28F 9/0204; F28F 9/0207;
(Continued)

(56) References Cited

U.S. PATENT DOCUMENTS 5,101,890 A * 4/1992 Aoki ..... F28F 9/0212 165/110
2003/0188859 A1* 10/2003 Muramoto ..... F28F 9/0202 165/140
(Continued)

FOREIGN PATENT DOCUMENTS

CN 106440920 A 2/2017
DE 19644711 A1 4/1998
(Continued)

OTHER PUBLICATIONS

International Search Report and Written Opinion mailed on Jan. 7, 2020, received for PCT Application PCT/JP2019/046566, Filed on Nov. 28, 2019, 13 pages including English Translation.
(Continued)

*Primary Examiner* — Frantz F Jules
*Assistant Examiner* — Jason N Thompson
(74) *Attorney, Agent, or Firm* — XSENSUS LLP

(57) ABSTRACT

A heat exchanger includes heat transfer tubes disposed in an up-down direction and a distributor distributes refrigerant to the heat transfer tubes. The distributor has a main body having a first flow passage through which refrigerant flows upward, and an insertion part disposed inside the main body. When an upper one and a lower one of two among the heat transfer tubes are a first heat transfer tube and a second heat transfer tube, respectively, the insertion part is installed between the first heat transfer tube and the second heat transfer tube. The main body has a second flow passage through which refrigerant flows upward. Refrigerant having passed through the first flow passage and the second flow passage flows through the first heat transfer tube, and refrigerant having passed through the first flow passage flows through the second heat transfer tube.

11 Claims, 23 Drawing Sheets

(51) Int. Cl.
*F28D 1/053* (2006.01)
*F28D 7/16* (2006.01)

(58) Field of Classification Search
CPC ..... F28F 9/026; F28F 9/0265; F28F 9/0268; F28F 9/028; F28F 9/0209; F28F 9/0212
See application file for complete search history.

(56) References Cited

U.S. PATENT DOCUMENTS

| | | | | |
|---|---|---|---|---|
| 2011/0088883 | A1 | 4/2011 | de la Cruz et al. | |
| 2015/0021003 | A1* | 1/2015 | Cho | F28F 9/028 165/145 |
| 2015/0292817 | A1* | 10/2015 | Shimanuki | F28D 1/05366 165/173 |
| 2016/0298887 | A1* | 10/2016 | Alahyari | F25B 39/00 |
| 2017/0023311 | A1 | 1/2017 | Urbanski | |
| 2017/0241684 | A1* | 8/2017 | Ito | F28F 9/0275 |
| 2017/0292741 | A1* | 10/2017 | Inoue | F28F 9/0202 |
| 2018/0073819 | A1 | 3/2018 | Kim et al. | |
| 2021/0231351 | A1 | 7/2021 | Miyawaki et al. | |

FOREIGN PATENT DOCUMENTS

| | | | |
|---|---|---|---|
| DE | 10322165 | A1 | 12/2004 |
| EP | 2778595 | A1 | 9/2014 |
| JP | 3210062 | B2 | 9/2001 |
| JP | 5376010 | B2 | 12/2013 |
| JP | 6466047 | B1 | 2/2019 |
| JP | 6551251 | B2 | 7/2019 |

OTHER PUBLICATIONS

Notice of Reasons for Refusal mailed on May 25, 2021, received for JP Application 2021-506345, 14 pages including English Translation.
Notice of Reasons for Refusal mailed on Oct. 12, 2020, received for JP Application 2021-506345, 9 pages Including English Translation.

* cited by examiner

HEAT EXCHANGER AND AIR-CONDITIONING APPARATUS

CROSS-REFERENCE TO RELATED APPLICATION

The present application is based on PCT filing PCT/JP2019/046566, filed Nov. 28, 2019, the entire contents of which are incorporated herein by reference.

TECHNICAL FIELD

The present disclosure relates to a heat exchanger and an air-conditioning apparatus including this heat exchanger and is used for a heat pump apparatus such as an air-conditioning apparatus.

BACKGROUND ART

A vapor-compression refrigeration cycle widely used in heat pump apparatuses, such as air-conditioning apparatuses, is usually composed of four element parts: a compressor, a heat exchanger serving as a condenser, a heat exchanger serving as an evaporator, and an expansion valve, or other components. In a refrigeration cycle, while refrigerant that is a working fluid flows through these four element parts, the refrigerant changes its state. Among some evaporators included in the vapor-compression refrigeration cycle, there is one that includes, to reduce flow loss, a plurality of heat transfer tubes and a distributor (header) that distributes refrigerant to the plurality of heat transfer tubes. Making the evaporator operate with high efficiency requires distributing the refrigerant evenly to each one of the plurality of heat transfer tubes.

Refrigerant flowing out of the expansion valve, which is in a state of two-phase gas-liquid refrigerant that is a mixture of low-temperature and low-pressure gas refrigerant and liquid refrigerant, tends to be unevenly distributed to the evaporator. In particular, when the distributor is disposed with its longitudinal direction oriented vertically, the low-density gas refrigerant and the high-density liquid refrigerant tend to separate from each other under the influence of gravity in the process of the refrigerant moving in the vertical direction.

In this connection, there is a proposed distributor having the following features: a space divided into a plurality of spaces is provided inside a cylindrical pipe that has a plurality of outflow pipe connection openings made in a longitudinal direction, and one space of the plurality of spaces inside the cylindrical pipe has small-diameter flow passages that each communicate with the corresponding one of the other spaces and is located upstream of the small-diameter flow passages, with an orifice provided between this one space and an inflow opening (e.g., see Patent Literature 1). In the distributor described in Patent Literature 1, refrigerant having flowed in in a two-phase gas-liquid state is evenly distributed through the small-diameter flow passages after the gas refrigerant and the liquid refrigerant of the refrigerant are homogeneously mixed at the orifice.

CITATION LIST

Patent Literature

Patent Literature 1: Japanese Patent No, 5376010

SUMMARY OF INVENTION

Technical Problem

In the distributor described in Patent Literature 1, small spaces of three branches are defined inside a space to which the refrigerant flows out of a small-diameter pipe. The concern is that, at the flow rate of the refrigerant divided into three branch flows to be supplied to the small spaces, the gas refrigerant and the liquid refrigerant of the two-phase gas-liquid refrigerant are likely to separate from each other inside the small spaces, with less of the liquid refrigerant flowing through the small space located at an upper part among the three branches.

Having been contrived to solve the above problem, the present disclosure aims to provide a heat exchanger and an air-conditioning apparatus having a distributor with improved refrigerant distribution performance.

Solution to Problem

A heat exchanger according to an embodiment of the present disclosure includes a plurality of heat transfer tubes disposed at intervals in an up-down direction and a distributor configured to distribute refrigerant to the plurality of heat transfer tubes. The distributor has a main body having a first inflow opening through which refrigerant flows in and a first flow passage through which refrigerant flowing in through the first inflow opening flows upward, and at least one insertion part disposed inside the main body. When an upper one and a lower one of two arbitrary heat transfer tubes among the plurality of heat transfer tubes arrayed in the up-down direction are referred to as a first heat transfer tube and a second heat transfer tube, respectively, the at least one insertion part installed between the first heat transfer tube and the second heat transfer tube has a first planar part that faces the first heat transfer tube and the second heat transfer tube and a second planar part that is formed on an edge of the first planar part and faces a wall surface of the main body.

The main body has a second flow passage that is surrounded by the second planar part and the wall surface of the main body and through which refrigerant flowing in through the first inflow opening flows upward. Refrigerant passing through the first flow passage and the second flow passage flows through the first heat transfer tube, and refrigerant passing through the first flow passage flows through the second heat transfer tube.

An air-conditioning apparatus according to an embodiment of the present disclosure includes a heat exchanger according to an embodiment of the present disclosure and a fan configured to supply air to the heat exchanger.

Advantageous Effects of Invention

According to an embodiment of the present disclosure, the distributor of the heat exchanger has the main body in which the insertion part is disposed. The main body has the second flow passage that is surrounded by the second planar part and the wall surface of the main body and through which the refrigerant having flowed in through the first inflow opening flows upward. The refrigerant having passed through the first flow passage and the second flow passage flows through the first heat transfer tube, and the refrigerant having passed through the first flow passage flows through the second heat transfer tube. Thus, the insertion part allows the heat exchanger to distribute the refrigerant evenly in the longitudinal direction of the main body of the distributor and thereby improve the refrigerant distribution performance.

DESCRIPTION OF EMBODIMENTS

A heat exchanger and an air-conditioning apparatus will be described hereinafter with reference to the drawings. Relative dimensional relationships, shapes, and other properties of components in the following drawings including FIG. 1 may be different from actual ones. In the following drawings, parts denoted by the same reference signs are the same or equivalent parts, which applies throughout the entire text of DESCRIPTION. Forms of constituent elements presented in the entire text of DESCRIPTION are merely examples and not intended to limit their forms to those described in DESCRIPTION. Words showing directions (e.g., "up," "down," "right," "left," "front," and "rear") will be used as necessary to help understanding, but these directions are thus written just for the convenience of description and not intended to limit the arrangement and the direction of a device or a part. In DESCRIPTION, the positional relationships among components, extension directions of components, and array directions of components are basically those when the heat exchanger is installed in a usable state.

Embodiment 1

[Refrigeration Cycle Apparatus 10]

Figure 1:
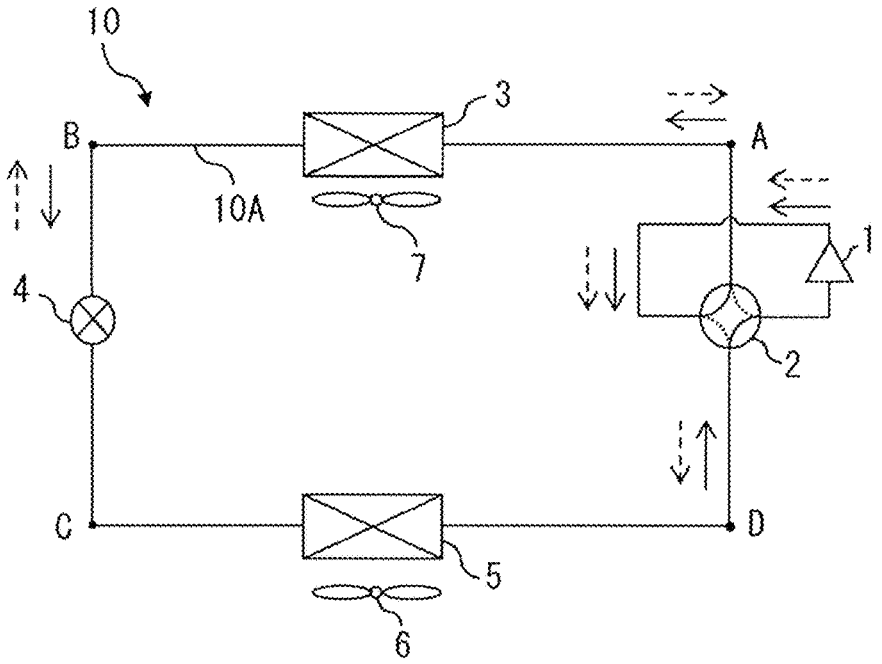
FIG. 1 is a refrigerant circuit diagram showing the configuration of a refrigeration cycle apparatus according to Embodiment 1.

FIG. 1 is a refrigerant circuit diagram showing the configuration of a refrigeration cycle apparatus 10 according to Embodiment 1. In FIG. 1, the arrows with broken lines show a flow direction of refrigerant during cooling operation in the refrigeration cycle apparatus 10, and the arrows with solid lines show a flow direction of the refrigerant during heating operation in the refrigeration cycle apparatus 10. In this embodiment, an air-conditioning apparatus composed of one outdoor heat exchanger 5 and one indoor heat exchanger 3, such as a room air conditioner for household use and a packaged air conditioner for shop or office use, is illustrated as the refrigeration cycle apparatus 10. While an air-conditioning apparatus is illustrated as the refrigeration cycle apparatus 10 in this embodiment, the refrigeration cycle apparatus 10 may be used for freezing purposes or air conditioning purposes, as in, for example, a refrigerator, a freezer, a vending machine, an air-conditioning apparatus, a refrigeration device, or a hot water supply device.

The refrigeration cycle apparatus 10 has a refrigerant circuit 10A in which a compressor 1, a flow passage switching device 2, the indoor heat exchanger 3, a depressurization device 4, and the outdoor heat exchanger 5 are circularly connected to one another through refrigerant pipes.

The compressor 1 is a fluid machine that compresses and then discharges refrigerant it has suctioned. The flow passage switching device 2 is, for example, a four-way valve and is a device that switches refrigerant flow passages between cooling operation and heating operation under control by a controller (not shown). The indoor heat exchanger 3 is a heat exchanger that exchanges heat between refrigerant flowing through its inside and indoor air supplied by an indoor fan 7. The indoor heat exchanger 3 serves as a condenser during heating operation and serves as an evaporator during cooling operation. The depressurization device 4 is, for example, an expansion valve and is a device that depressurizes refrigerant. As the depressurization device 4, an electronic expansion valve of which the opening degree is adjusted under control by the controller is available. The outdoor heat exchanger 5 is a heat exchanger that exchanges heat between refrigerant flowing through its inside and air supplied by an outdoor fan 6. The outdoor heat exchanger 5 serves as an evaporator during heating operation and serves as a condenser during cooling operation.

[Operation of Refrigeration Cycle Apparatus 10]

Next, an operation state of the refrigeration cycle apparatus 10 during heating operation will be described along a flow of refrigerant with reference to FIG. 1. High-temperature and high-pressure gas refrigerant having been compressed in the compressor 1 passes through the flow passage switching device 2 and reaches a point A. After passing the point A, the gas refrigerant passes through the indoor heat exchanger 3, while the indoor heat exchanger 3 works as a condenser, so that the refrigerant reaches a point B in a state of having been cooled and liquefied by air fed by the indoor fan 7, The liquid refrigerant resulting from liquefaction passes through the depressurization device 4 and thereby transitions to a state of two-phase refrigerant that is a mixture of low-temperature and low-pressure gas refrigerant and liquid refrigerant, and reaches a point C. Thereafter, the two-phase refrigerant having passed the point C flows through the inside of the outdoor heat exchanger 5, while the outdoor heat exchanger 5 works as an evaporator, so that the refrigerant reaches a point D in a state of having been heated and gasified by air fed by the outdoor fan 6. The gas refrigerant having passed the point D passes through the flow passage switching device 2 and returns to the compressor 1. By this cycle, the refrigeration cycle apparatus 10 performs heating operation of heating the indoor air.

Next, an operation state of the refrigeration cycle apparatus 10 during cooling operation will be described along a flow of refrigerant with reference to FIG. 1. For cooling operation of the refrigeration cycle apparatus 10, the refrigerant flow direction is switched using the flow passage switching device 2 such that the refrigerant flows in the reverse direction to the above-described direction. High-temperature and high-pressure gas refrigerant having been compressed in the compressor 1 passes through the flow passage switching device 2 and reaches the point D. After passing through the point D, the gas refrigerant passes through the outdoor heat exchanger 5, while the outdoor heat exchanger 5 works as a condenser, so that the refrigerant reaches the point C in a state of having been cooled and liquefied by air fed by the outdoor fan 6. The liquid refrigerant resulting from liquefaction passes through the depressurization device 4 and thereby transitions to a state of two-phase refrigerant that is a mixture of low-temperature and low-pressure gas refrigerant and liquid refrigerant, and reaches the point B. Thereafter, the two-phase refrigerant having passed the point B flows through the inside of the indoor heat exchanger 3, while the indoor heat exchanger 3 works as a condenser, so that the refrigerant reaches the point A in a state of having been heated and gasified by air fed by the indoor fan 7. The gas refrigerant having passed the point A passes through the flow passage switching device 2 and returns to the compressor 1. By this cycle, the refrigeration cycle apparatus 10 performs cooling operation of coaling the indoor air.

[Heat Exchanger 50]

Figure 2:
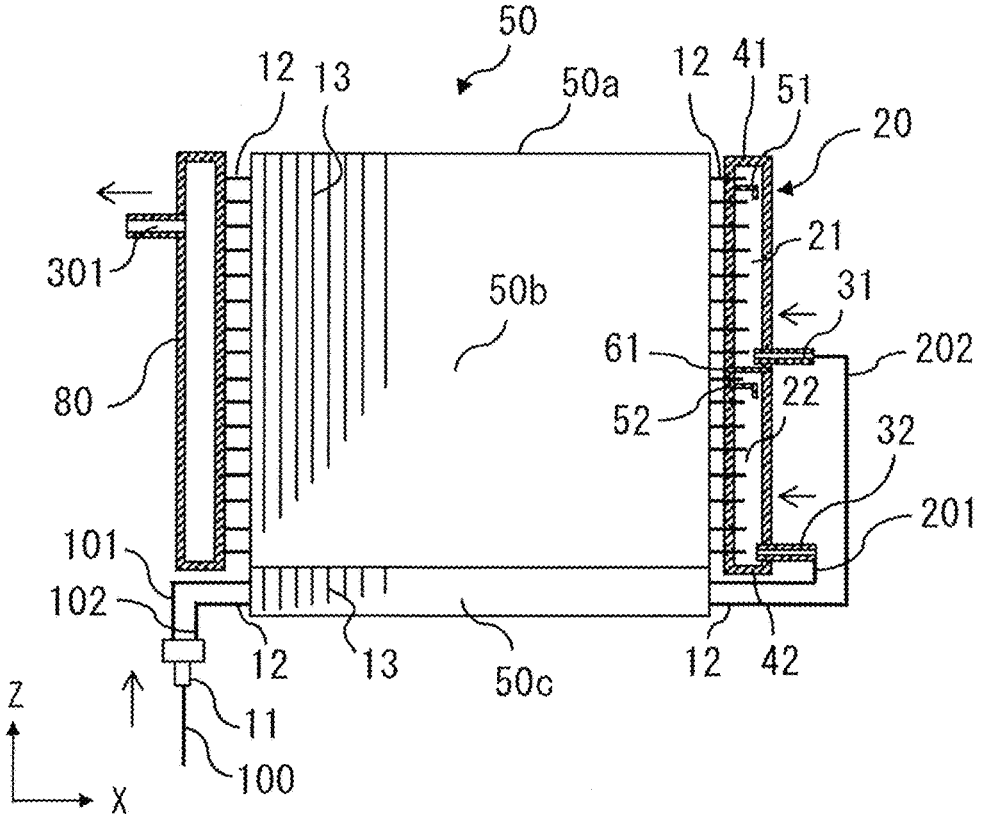
FIG. 2 is a schematic view of a heat exchanger according to Embodiment 1.

FIG. 2 is a schematic view of a heat exchanger 50 according to Embodiment 1. Next, the heat exchanger 50 according to Embodiment 1 will be described. In the following description, the configuration of the heat exchanger 50 in a case where the heat exchanger 50 is used as the outdoor heat exchanger 5 serving as an evaporator when the refrigeration cycle apparatus 10 is used for heating operation will be described. However, the heat exchanger 50 is not limited to that used as the outdoor heat exchanger 5 and may also be used as the indoor heat exchanger 3.

As shown in FIG. 2, the heat exchanger 50 has a heat exchange unit 50*a*, a header 80, and a distributor 20.

(Heat Exchange Unit 50*a*)

The heat exchange unit 50*a* causes heat exchange between air present around the heat exchange unit 50*a* and refrigerant flowing through an inside of the heat exchange unit 50*a*. The heat exchange unit 50*a* is disposed between the distributor 20 and the header 80. The heat exchange unit 50*a* has a plurality of heat transfer tubes 12 that extend in a first direction (X-axis direction) and heat transfer promotion parts 13 that connect adjacent ones of the heat transfer tubes 12 to each other.

Each of the plurality of heat transfer tubes 12 allows refrigerant to flow through its inside. Each of the plurality of heat transfer tubes 12 extends between the distributor 20 and the header 80. The plurality of heat transfer tubes 12 are arranged at intervals and arrayed in an axial direction that is an extension direction of the distributor 20 in which the distributor 20 extends (Z-axis direction). The plurality of heat transfer tubes 12 are disposed at intervals in an up-down direction. The plurality of heat transfer tubes 12 are disposed such that they face one another, A clearance serving as an air flow passage is left between each pair of adjacent heat transfer tubes 12 among the plurality of heat transfer tubes 12.

In the heat exchanger 50, an extension direction of the plurality of heat transfer tubes 12 in which the plurality of heat transfer tubes 12 extend and, which is the first direction, is a horizontal direction. However, the extension direction of the plurality of heat transfer tubes 12, which is the first direction, is not limited to the horizontal direction and may instead be a direction inclined from the horizontal direction. Similarly, in the heat exchanger 50, an array direction of the plurality of heat transfer tubes 12 in which the plurality of heat transfer tubes 12 are arrayed and, which is the second direction, is a vertical direction. However, the array direction of the plurality of heat transfer tubes 12 is not limited to the vertical direction and may instead be a direction inclined from the vertical direction.

The heat transfer tubes 12 are, for example, circular tubes with a circular cross-section or tubes with an elliptical cross-section. Alternatively, the heat transfer tubes 12 may be flat tubes with a plurality of flow passages formed inside.

Adjacent heat transfer tubes 12 among the plurality of heat transfer tubes 12 are connected to each other by the heat transfer promotion parts 13. The heat transfer promotion part 13 is, for example, a plate fin or a corrugated fin. The heat transfer promotion part 13 increases the efficiency of heat exchange between air and refrigerant. The plurality of heat transfer promotion parts 13 are arranged in the heat exchange unit 50*a* at intervals and arrayed in the extension direction of the heat transfer tubes 12 (X-axis direction). When the heat transfer promotion part 13 is a plate fin, the plurality of heat transfer tubes 12 extend through the plurality of heat transfer promotion parts 13.

The heat exchange unit 50*a* is not limited to the one having the heat transfer tubes 12 and the heat transfer promotion parts 13, For example, the heat exchange unit 50*a* may have a configuration that includes the heat transfer tubes 12 but does not include the heat transfer promotion parts 13 connecting adjacent heat transfer tubes 12 to each other.

As one example, the heat exchange unit 50*a* is composed of an auxiliary heat exchange unit 50*c* located upstream in a flow of refrigerant and a main heat exchange unit 50*b* located downstream in the flow of the refrigerant as shown in FIG. 2. The distributor 20 is disposed on one end of the main heat exchange unit 50*b* and the header 80 is disposed on the other end of the main heat exchange unit 50*b*.

In the heat exchanger 50, two branch flows of the refrigerant each flow through the auxiliary heat exchange unit 50*c*, which is a part of the heat exchange unit 50*a*, and then pass through the distributor 20 and thereby split into 16 branch flows of the refrigerant, which each flow through the main heat exchange unit 50*b*, which is another part of the heat exchange unit 50*a*. The configuration of the heat exchange unit 50*a* is not limited to the above-described one that includes the auxiliary heat exchange unit 50*c* located upstream in the flow of the refrigerant and the main heat exchange unit 50*b* located downstream in the flow of the refrigerant. For example, in the heat exchange unit 50*a*, the numbers of the branch flows of the refrigerant in the auxiliary heat exchange unit 50*c* and the main heat exchange unit 50*b* may be other numbers than two and 16 mentioned above. Alternatively, the heat exchange unit 50*a* may not need the auxiliary heat exchange unit 50*c* and may be composed only of the main heat exchange unit 50*b*.

(Header 80)

The header 80 is connected to ends of the plurality of heat transfer tubes 12 at one side in the extension direction of the plurality of heat transfer tubes 12 (X-axis direction). The header 80 is connected to the heat transfer tubes 12 of the heat exchange unit 50*a* such that an inside of the header 80 and an inside of a tube passage of each heat transfer tube 12 communicate with each other. The header 80 is formed to extend along the array direction of the plurality of heat transfer tubes 12 (Z-axis direction). The header 80 serves as a fluid merging mechanism when branch flows of the refrigerant that are to flow out of the heat exchanger 50 flow out of the plurality of heat transfer tubes 12 and merge.

The header 80 is provide with an outflow pipe 301. The outflow pipe 301 is a pipe through which the branch flows of refrigerant having flowed out of the plurality of heat transfer tubes 12 and merged are discharged from the heat exchanger 50.

(Distributor 20)

The distributor 20 is connected to ends of the plurality of heat transfer tubes 12 at the other side in the extension direction of the plurality of heat transfer tubes 12 (X-axis direction). The distributor 20 is disposed across the plurality of heat transfer tubes 12 and opposite to the header 80. The distributor 20 is connected to the heat transfer tubes 12 of the heat exchange unit 50*a* such that an inside of the distributor 20 and the inside of the tube passages of each heat transfer tube 12 communicate with each other. The distributor 20 is formed to extend along the array direction of the plurality of heat transfer tubes 12 (Z-axis direction). The distributor 20 distributes the refrigerant to the plurality of heat transfer tubes 12. In the heat exchanger 50, the distributor 20 serves as a fluid distribution mechanism that distributes the refrigerant flowing into the heat exchanger 50 to the plurality of heat transfer tubes 12.

The distributor 20 is provided with an inflow pipe 31 and an inflow pipe 32. The inflow pipe 31 and the inflow pipe 32 are pipes through which the refrigerant to be distributed to the plurality of heat transfer tubes 12 flows into the heat exchanger 50. The detailed configuration of the distributor 20 will be described later.

Example of Operation of Heat Exchanger 50

The operation of the heat exchanger 50 according to Embodiment 1 will be described using the operation of the heat exchanger 50 when it serves as an evaporator of the refrigeration cycle apparatus 10 as an example. Two-phase gas-liquid refrigerant having been depressurized in a depressurization device 104 flows into the heat exchanger 50 serving as an evaporator. At this time, the refrigerant flows in from the distributor 20 of the heat exchanger 50 and flows through passages inside the plurality of heat transfer tubes 12 to absorb heat and evaporate. Thereafter, the refrigerant flows out of the header 80 and circulates through the refrigerant circuit 10A.

The example of the operation of the heat exchanger 50 will be described in more detail with reference to FIG. 2. When a quality X that is an expression of a ratio of a mass velocity of a gas to a mass velocity of entire two-phase gas-liquid refrigerant is used, the refrigerant flowing through the heat exchanger 50 flows from a pipe 100 into a bifurcated pipe 11 in FIG. 2 in a two-phase gas-liquid state with the quality X within a range of about 0.05 to 0.30.

Thereafter, the two-phase gas-liquid refrigerant is divided by the bifurcated pipe 11 and the divided flows of the refrigerant each flow through a pipe 101 and a pipe 102 and then to the auxiliary heat exchange unit 50*c*, which is a part of the heat exchange unit 50*a*. At this time, the two-phase gas-liquid refrigerant flowing through the heat transfer tubes 12 of the auxiliary heat exchange unit 50*c* and air fed by the outdoor fan 6 (not shown) exchange heat with each other. As the two-phase gas-liquid refrigerant and the air exchange heat with each other, the liquid refrigerant of the two-phase gas-liquid refrigerant evaporates. Thus, the two-phase gas-liquid refrigerant passes through the auxiliary heat exchange unit 50*c* to the end of the auxiliary heat exchange unit 50*c* while changing the ratio of the mass velocity of the gas to the mass velocity of the entire two-phase gas-liquid refrigerant.

The two-phase gas-liquid refrigerant having passed through the auxiliary heat exchange unit 50*c* flows through the inflow pipe 32 and the inflow pipe 31 through a pipe 201 and a pipe 202, respectively. At this time, the quality X of the two-phase gas-liquid refrigerant flowing through the inflow pipe 31 and the inflow pipe 32 may be within a range of about 0.05 to 0.60. The value of the quality X varies with the influence of factors such as the proportion of the auxiliary heat exchange unit 50*c* in the entire heat exchange unit 50*a*, the amount of air passing through the auxiliary heat exchange unit 50*c*, and a pressure loss occurring from the bifurcated pipe 11 to the inflow pipe 31 and the inflow pipe 32.

The two-phase gas-liquid refrigerant having passed through the inflow pipe 31 and the inflow pipe 32 flows into a space 21 and a space 22 defined inside the distributor 20. The two-phase gas-liquid refrigerant having flowed into the space 21 and the space 22 is divided into eight branch flows in each of the space 21 and the space 22, i.e., a total of 16 branch flows, and flows through the heat transfer tubes 12.

The two-phase gas-liquid refrigerant having been divided into 16 branch flows flows through the main heat exchange unit 50*b*, which is a part of the heat exchange unit 50*a*, and air fed by the outdoor fan 6 (not shown) and the two-phase gas-liquid refrigerant exchange heat with each other again. As a result of heat exchange with the air, the refrigerant passing through the main heat exchange unit 50*b* transitions to a state of gas refrigerant in which all the liquid refrigerant has been gasified or a state of two-phase gas-liquid refrigerant in which most of the liquid refrigerant has been gasified and the quality X is 0.85 or higher, and flows out to the header 80. The 16 branch flows of the refrigerant merge in the header 80 and flow out of the heat exchanger 50 through the outflow pipe 301.

(Detailed Configuration of Distributor 20)

Figure 3:
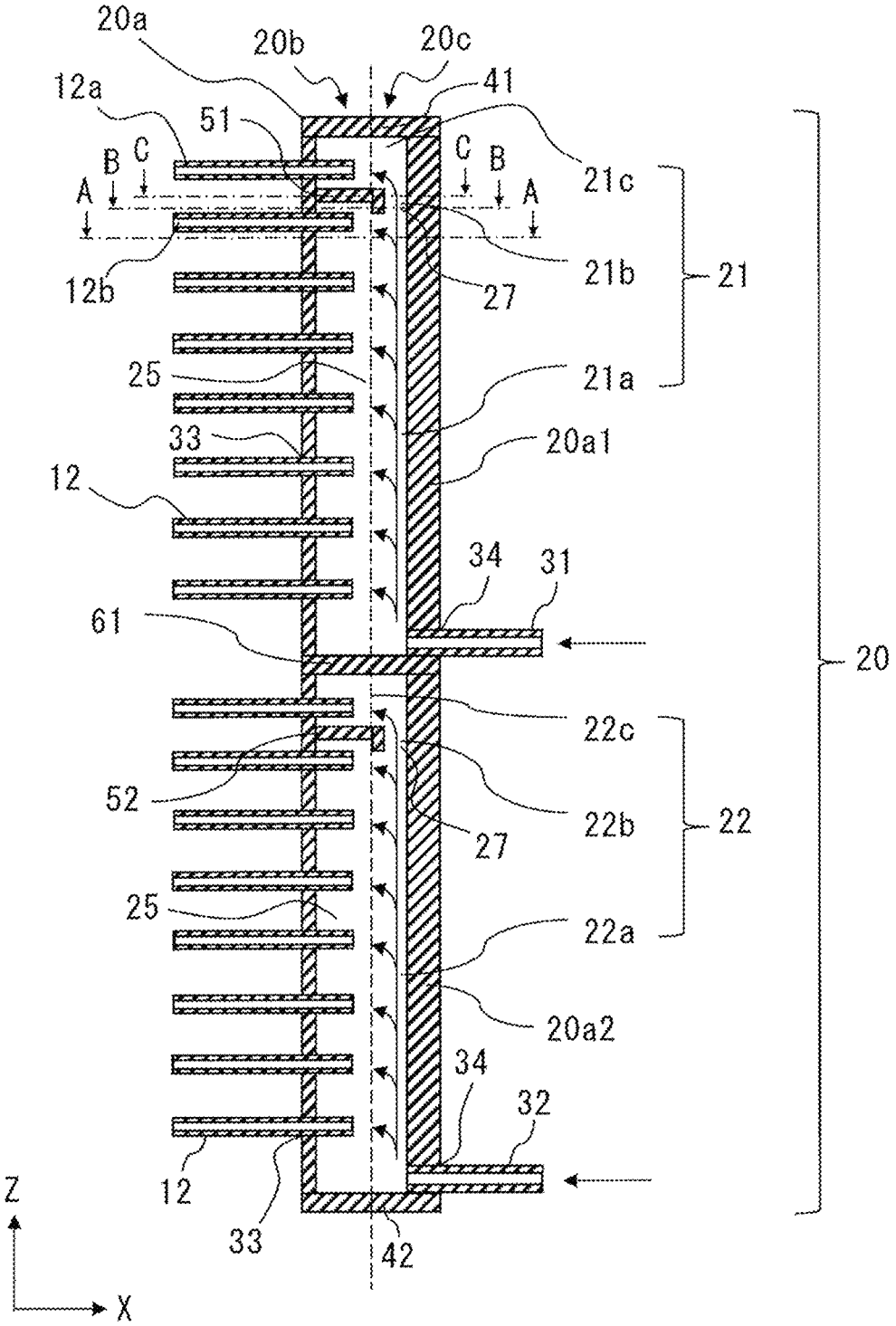
FIG. 3 is a schematic view of a distributor relating to Embodiment 1.
Figure 4:
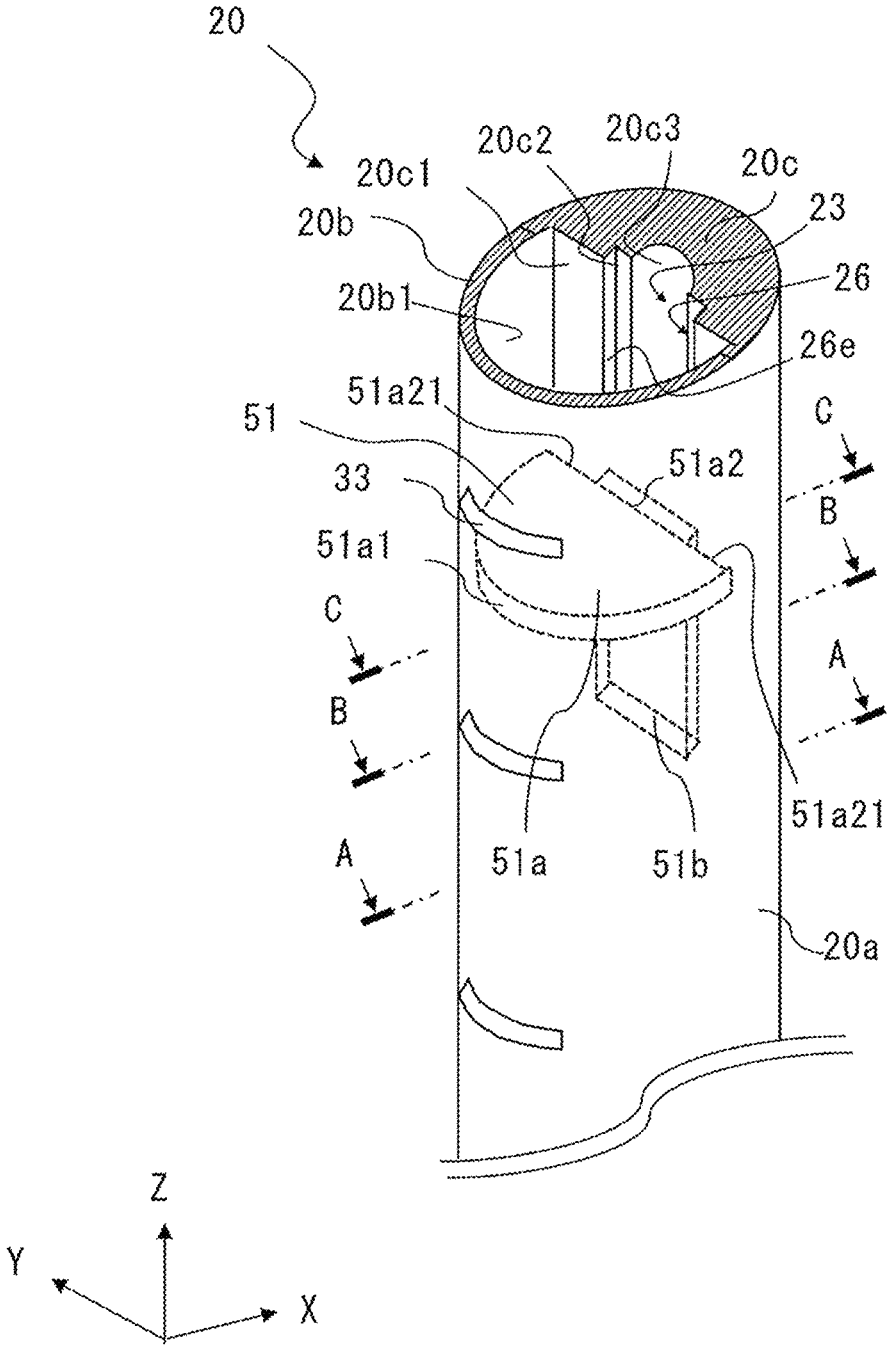
FIG. 4 is a perspective view of the distributor according to Embodiment 1.

FIG. 3 is a schematic view of the distributor 20 relating to Embodiment 1. FIG. 4 is a perspective view of the distributor 20 according to Embodiment 1. In FIG. 4, depiction of a lid 41 is omitted to illustrate the internal structure of the distributor 20. The X-axis direction shown in FIG. 4 is the extension direction of the heat transfer tubes 12, and the Z-axis direction is an extension direction of a main body 20*a* of the distributor 20 in which the main body 20*a* extends. The Z-axis direction is also the array direction of the heat transfer tubes 12. The Y-axis direction shown in FIG. 4 is a direction perpendicular to the X-axis direction and the Z-axis direction. The distributor 20 will be described with reference to FIG. 3 and FIG. 4. The distributor 20 has the main body 20*a*, the inflow pipe 31 and the inflow pipe 32 mounted on the main body 20*a*, and at least one insertion part 51 inserted in the main body 20*a*.

(Main Body 20*a*)

The main body 20*a* is a part having a shape of an elongated tube closed at both ends and has a space defined inside. The main body 20*a* is installed in a state where its central axis in a longitudinal direction (Z-axis direction) is oriented vertically or a state where the central axis in the longitudinal direction is inclined within a range within which the central axis in the longitudinal direction has a vertical vector component. The main body 20*a* has inflow openings 34 that are first inflow openings through which the refrigerant flows in, and first flow passages 25 through which the refrigerant having flowed in through the inflow openings 34 flows upward. The main body 20*a* has a frame-shaped part 20*b*, a columnar part 20*c*, the lid 41, and a lid 42. The main body 20*a* has a shape of a tube formed by a combination of the frame-shaped part 20*b* and the columnar part 20*c*, and both ends of the tube formed by the frame-shaped part 20*b* and the columnar part 20*c* are closed by the lid 41 and the lid 42. The main body 20*a* has a shape of a column formed by a combination of the frame-shaped part 20*b*, the columnar part 20*c*, the lid 41, and the lid 42. The main body 20*a* is not limited to the one having a columnar shape. For example, the main body 20*a* may have a polygonal prism shape, such as a quadrangular prism shape.

The frame-shaped part 20*b* is a first part. The frame-shaped part 20*b*, which is the first part, is a part having an elongated shape, and its cross-section perpendicular to a longitudinal direction (Z-axis direction) has an arc shape. The frame-shaped part 20*b* has connection openings 33 through which the heat transfer tubes 12 are inserted. The plurality of connection openings 33 are made as through-holes along the longitudinal direction of the frame-shaped part 20*b* (Z-axis direction). The main body 20*a* has the plurality of connection openings 33, which are made at intervals in the up-down direction and through which the plurality of heat transfer tubes 12 are inserted. When the heat transfer tubes 12 are inserted through the connection openings 33, the heat transfer tubes 12 extend through a wall of the frame-shaped part 20*b*. The heat transfer tubes 12 inserted through the connection openings 33 are retained by the frame-shaped part 20*b*.

The columnar part 20*c* is a second part. The columnar part 20*c*, which is the second part, is a part having an elongated shape, and its cross-section perpendicular to a longitudinal direction (Z-axis direction) has a substantially semicircular shape. The columnar part 20*c* has the inflow openings 34 through which the inflow pipe 31 and the inflow pipe 32 are inserted. The inflow openings 34 are first inflow openings and through-holes. When the inflow pipe 31 and the inflow pipe 32 are inserted through the inflow openings 34, the inflow pipe 31 and the inflow pipe 32 extend through a wall of the columnar part 20*c*. The inflow pipe 31 and the inflow pipe 32 inserted through the inflow openings 34 are retained by the columnar part 20*c* One of the inflow openings 34, which is the first inflow opening, is made at a position facing one of the plurality of heat transfer tubes 12 that is located at a lowest part inside the main body 20*a*. Alternatively, as shown in FIG. 3, one of the inflow openings 34, which is the first inflow opening, is made at a lower position than a position of the one of the plurality of heat transfer tubes 12 that is located at the lowest part inside the main body 20*a*.

As shown in FIG. 4, the columnar part 20*c*, which is a part of the main body 20*a*, has a groove 26 and a recess 23. The groove 26 is a groove formed in an inner wall surface 20*c*1 of the columnar part 20*c* and forms a second inner wall surface 20*c*2 recessed from the inner wall surface 20*c*1. The groove 26 is formed by side walls 26*e* that face each other in the Y-axis direction and the second inner wall surface 20*c*2. The groove 26 is formed along the longitudinal direction of the main body 20*a* (Z-axis direction).

The second inner wall surface 20*c*2 of the groove 26 has the recess 23 having a groove shape. In a side view seen from a direction perpendicular to the longitudinal direction of the main body 20*a* (Z-axis direction), the width of the groove 26 in the Y-axis direction is larger than the maximum width of the recess 23 in the Y-axis direction. The recess 23 is formed along the longitudinal direction of the main body 20*a* (Z-axis direction). The recess 23 is formed along an extension direction of the groove 26 in which the groove 26 extends. The recess 23 forms a third inner wall surface 20*c*3 that is recessed from the second inner wall surface 20*c*2. The third inner wall surface 20*c*3 is formed as a curved surface, and has an arc shape in a plan view seen from a direction parallel to the longitudinal direction of the main body 20*a* (Z-axis direction) A space 21*b*, to be described later, of the recess 23 is defined by the third inner wall surface 20*c*3 and a flow passage wall 51*b* to be described later. The main body 20*a* has at least one recess 23 that has a shape of a groove extending in the up-down direction and is formed at a position facing the plurality of connection openings 33.

In a typical manufacturing method of the main body 20*a*, the frame-shaped part 20*b* is formed by pressing to make the connection openings 33 and bending to form a curved surface, and the columnar part 20*c* is formed by extrusion. However, the manufacturing method of the main body 20*a* is not limited to this forming method. For example, a manufacturing method of the main body 20*a* may be used in which the main body 20*a* integrally having the frame-shaped part 20*b* and the columnar part 20*c* is formed by extrusion and then the connection openings 33 are made in the main body 20*a*.

The lid 41 and the lid 42 are parts that cover both ends of the tube formed by the frame-shaped part 20*b* and the columnar part 20*c*. The lid 41 and the lid 42 each have a plate shape. The lid 41 and the lid 42 close both ends of the main body 20*a* in the longitudinal direction (Z-axis direction) and thus define an internal space in the main body 20*a*.

Inside the main body 20*a*, a partition plate 61 that divides the internal space of the main body 20*a* into an upper space and a lower space is provided, Inside the main body 20*a*, the upper space 21 and the lower space 22 are partly defined by the partition plate 61. Of the internal space of the main body 20*a*, the upper space 21 is a space that is defined above the partition plate 61 and the lower space 22 is a space that is defined below the partition plate 61. Since the upper space 21 and the lower space 22 are separated from each other by the partition plate 61, the refrigerant does not move from one to the other of the upper space 21 and the lower space 22.

A part of the main body 20*a* that defines the upper space 21 is an upper main body 20*a*1 and a part of the main body 20*a* that defines the lower space 22 is a lower main body 20*a*2. The upper main body 20*a*1 and the lower main body 20*a*2 each have the connection openings 33 and the inflow opening 34. As shown in FIG. 2 and FIG. 3, eight connection openings 33 are made in each of the upper main body 20*a*1 and the lower main body 20*a*2, and a total of 16 connection openings 33 are made in the main body 20*a* as a whole. Ones of the plurality of heat transfer tubes 12 extend through the connection openings 33 of the upper main body 20*a*1, while the others of the plurality of heat transfer tubes 12 extend through the connection openings 33 of the lower main body 20*a*2. The ones of the plurality of heat transfer tubes 12 are mounted on the upper main body 20*a*1, while the others of the plurality of heat transfer tubes 12 are mounted on the lower main body 20*a*2. The number of the connection openings 33 made in the main body 20*a* is not limited to 16. The number of the connection openings 33 to be made is determined by the number of the heat transfer tubes 12 included in the heat exchange unit 50*a*.

The upper main body 20*a*1 has the insertion part 51 and the lower main body 20*a*2 has an insertion part 52. The insertion part 51 is disposed inside the space 21 and the insertion part 52 is disposed inside the space 22. The insertion part 51 and the insertion part 52 are provided between the frame-shaped part 20*b* and the columnar part 20*c*. The detailed configuration of the insertion part 51 and the insertion part 52 will be described later.

(Inflow Pipe 31 and Inflow Pipe 32)

The inflow pipe 31 and the inflow pipe 32 are mounted on the main body 20*a*. The inflow pipe 31 is mounted on the upper main body 20*a*1, and the inflow pipe 32 is mounted on the lower main body 20*a*2. The inflow pipe 31 and the inflow pipe 32 communicate with the internal space of the main body 20*a*, The inflow pipe 31 communicates with the upper space 21 and the inflow pipe 32 communicates with the lower space 22. The two-phase gas-liquid refrigerant flowing through the internal space of the main body 20*a* flows into the inflow pipe 31 and the inflow pipe 32 when the heat exchanger 50 serves as an evaporator. As shown in FIG. 2, the inflow pipe 31 is connected to the pipe 202 and the inflow pipe 32 is connected to the pipe 201. When the heat exchange unit 50*a* does not have the auxiliary heat exchange unit 50*c*, the inflow pipe 31 and the inflow pipe 32 may be connected to the bifurcated pipe 11 through the pipe 101 and the pipe 102.

Next, mounting positions of the inflow pipe 31 and the inflow pipe 32 will be described with reference to FIG. 3. It is desirable that the inflow pipe 31 be mounted, along the extension direction of the heat transfer tubes 12 (X-axis direction), at a position facing the heat transfer tube 12 located at a lowest level in the space 21*a* or a position at which the two-phase gas-liquid refrigerant flows into a space below the heat transfer tube 12 located at the lowest level. Similarly, it is desirable that the inflow pipe 32 be mounted, along the extension direction of the heat transfer tubes 12 (X-axis direction), at a position facing the heat transfer tube 12 located at a lowest level in the space 22*a* or a position at which the two-phase gas-liquid refrigerant flows into a space below the heat transfer tube 12 located at the lowest level.

In a case where the inflow pipe 31 or the inflow pipe 32 is mounted between two heat transfer tubes 12 inside the space 21*a* or the space 22*a*, an upward flow and a downward flow of the refrigerant are generated, so that a flow velocity for sending the two-phase gas-liquid refrigerant upward decreases. A decrease in the flow velocity for sending the two-phase gas-liquid refrigerant upward causes the gas refrigerant and the liquid refrigerant to be easily separated from each other. It is therefore desirable that the inflow pipe 31 and the inflow pipe 32 be mounted at the above-described positions.

(Insertion Part 51 and Insertion Part 52)

The insertion part 51 and the insertion part 52 will be described with reference to FIG. 3 and FIG. 4. As the insertion part 52 has the same structure as the insertion part 51, the insertion part 51 will be described in the following description while description of the insertion part 52 will be omitted.

The insertion part 51 has a partition plane 51*a* that contacts the frame-shaped part 20*b* and the columnar part 20*c*, and the flow passage wall 51*b*, which contacts the columnar part 20*c*. The partition plane 51*a* and the flow passage wall 51*b* are formed as one part but may instead be formed as separate parts. In the distributor 20, the partition plane 51*a* is a first planar part and the flow passage wall 51*b* is a second planar part.

The partition plane 51*a* is a plate-shaped part perpendicular to the longitudinal direction of the main body 20*a* (Z-axis direction). As shown in FIG. 4, the partition plane 51*a* having a plate shape forms an X-Y plane. The partition plane 51*a* has a semicircular shape in a plan view seen from the direction parallel to the longitudinal direction of the main body 20*a* (Z-axis direction). The partition plane 51*a* is disposed between two of the plurality of connection openings 33 made in the longitudinal direction of the frame-shaped part 20*b* (Z-axis direction), Thus, in the longitudinal direction of the main body 20*a* (Z-axis direction), the partition plane 51*a* is disposed between two heat transfer tubes 12 inserted through the connection openings 33. For example, an upper one and a lower one of two arbitrary heat transfer tubes 12 among the plurality of heat transfer tubes 12 arrayed in the up-down direction will be referred to as a first heat transfer tube 12*a* and a second heat transfer tube 12*b*, respectively. In the distributor 20 of Embodiment 1, the first heat transfer tube 12*a* is one of the plurality of heat transfer tubes 12 that is disposed at a highest part, and the second heat transfer tube 12*b* is the heat transfer tube 12 that is disposed immediately under the first heat transfer tube 12*a*. The insertion part 51 installed between the first heat transfer tube 12*a* and the second heat transfer tube 12*b* has the partition plane 51*a*, which is the first planar part and faces the first heat transfer tube 12*a* and the second heat transfer tube 12*b*, and the flow passage wall 51*b*, which is the second planar part and faces the third inner wall surface 20*c*3 of the main body 20*a*.

The partition plane 51*a* is a plate-shaped part, and has a curved part 51*a*1 that has an arc shape in a plan view seen from the direction parallel to the longitudinal direction of the main body 20*a* (Z-axis direction) and a straight part 51*a*2 that is provided between both ends of the curved part 51*a*1 and has a straight shape in the plan view. The curved part 51*a*1 forms a curve that is convex and opposite to a position at which the columnar part 20*c* is disposed. The straight part 51*a*2 extends in the Y-axis direction. In the partition plane 51*a*, the curved part 51*a*1 forms a side wall having a curved surface and the straight part 51*a*2 forms a side wall having a flat surface. The shape of the curved part 51*a*1 is not limited to an arc shape in a plan view seen from the direction parallel to the longitudinal direction of the main body 20*a* (Z-axis direction) but may instead be, for example, an arch shape or a horseshoe shape.

When the insertion part 51 is disposed inside the main body 20*a*, the curved part 51*a*1 contacts an inner wall surface 20*b*1 of the frame-shaped part 20*b*. The inner wall surface 20*b*1 of the frame-shaped part 20*b* is formed as a curved surface. The straight part 51*a*2 is an edge of the partition plane 51*a*, which is the first planar part. The straight part 51*a*2 and an upper end portion of the flow passage wall 51*b* are integrally formed. In a plan view seen from the direction parallel to the longitudinal direction of the main body 20*a* (Z-axis direction), the flow passage wall 51*b* protrudes from the straight part 51*a*2. In a plan view seen from the direction parallel to the longitudinal direction of the main body 20*a* (Z-axis direction), the width of the partition plane 51*a* in the Y-axis direction is larger than the width of the flow passage wall 51*b*. Contact portions 51*a*21 of the straight part 51*a*2 on which the flow passage wall 51*b* is not formed contact the inner wall surface 20*c*1 of the columnar part 20*c* when the insertion part 51 is disposed inside the main body 20*a*. The inner wall surface 20*c*1 of the frame-shaped part 20*b* is formed as a flat surface.

The flow passage wall 51*b* is a plate-shaped part extending in the longitudinal direction of the main body 20*a* (Z-axis direction). In a side view seen from the direction perpendicular to the longitudinal direction of the main body 20*a* (Z-axis direction), the flow passage wall 51*b* has a rectangular shape. As shown in FIG. 4, the flow passage wall 51*b* having a plate shape forms a Y-Z plane. Thus, the flow passage wall 51*b* has a quadrangular prism shape. The flow passage wall 51*b* is formed to extend downward from the vicinity of the center of the straight part 51*a*2 in the Y-axis direction. The flow passage wall 51*b* is formed at a position facing the groove 26 when the insertion part 51 is disposed inside the main body 20*a*.

The insertion part 51 is mounted inside the main body 20*a* as the flow passage wall 51*b* is press-fitted into the groove 26. Therefore, when the insertion part 51 is disposed inside the main body 20*a*, the flow passage wall 51*b* is disposed in the groove 26 of the columnar part 20*c*, When the insertion part 51 is disposed inside the main body 20*a*, the flow passage wall 51*b* is disposed in the groove 26 of the columnar part 20*c* and the space 21*b* is thus defined by the recess 23.

For example, the insertion part 51 is formed into an L-shape as a flat plate with a thickness of about 1 mm is bent by pressing. By thus pressing a flat plate, the insertion part Si is formed to have the partition plane 51*a* forming an X-Y plane and the flow passage wall 51*b* forming a Y-Z plane. The insertion part 51 composed of the partition plane 51*a* and the flow passage wall 51*b* has a small volume and is easy to produce. Therefore, the material cost and the production cost of the insertion part 51 are lower than those of some insertion part, which allows the distributor 20 and the heat exchanger 50 to be produced at low costs. Further, the insertion part 51 is mounted on the main body 20*a* by press-fitting the flow passage wall 51*b* into the groove 26 of the columnar part 20*c*. This allows a worker to easily mount the insertion part 51 on the main body 20*a* and thereby facilitates the production of the distributor 20 and the heat exchanger 50.

Figure 5:
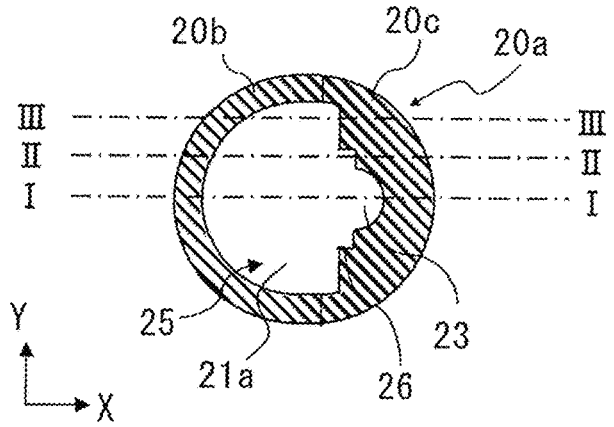
FIG. 5 is a sectional view along line A-A shown in FIG. 3 and FIG. 4, perpendicular to an extension direction of a main body in which the main body extends.
Figure 6:
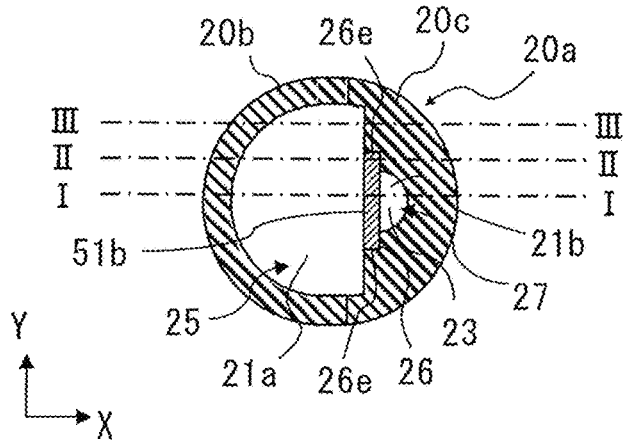
FIG. 6 is a sectional view along line B-B shown in FIG. 3 and FIG. 4, perpendicular to the extension direction of the main body.
Figure 7:
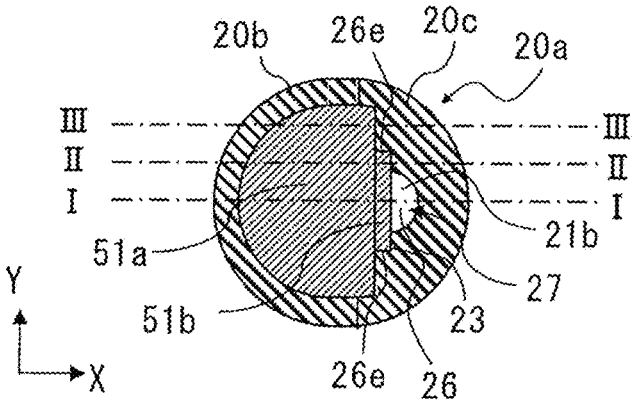
FIG. 7 is a sectional view along line C-C shown in FIG. 3 and FIG. 4, perpendicular to the extension direction of the main body.

FIG. 5 is a sectional view along line A-A shown in FIG. 3 and FIG. 4, perpendicular to the extension direction of the main body 20*a*. FIG. 6 is a sectional view along line B-B shown in FIG. 3 and FIG. 4, perpendicular to the extension direction of the main body 20*a*. FIG. 7 is a sectional view along line C-C shown in FIG. 3 and FIG. 4, perpendicular to the extension direction of the main body 20*a*. A sectional view perpendicular to the extension direction of the main body 20*a* means a sectional view represented by an X-Y plane. For the section of the distributor 20 at the position of line A-A, a section at a position that does not involve the insertion part 51 is shown. For the section of the distributor 20 at the position of line B-B, a section at a position that involves the flow passage wall 51*b* of the insertion part 51 is shown. For the section of the distributor 20 at the position of line C-C, a section at a position that involves the partition plane 51*a* of the insertion part 51 is shown.

As shown in FIG. 5 and FIG. 6, at the position of the section along line A-A and the position of the section along line B-B, the space 21*a* surrounded by the frame-shaped part 20*b* and the columnar part 20*c* is defined as the first flow passage 25 in the main body 20*a* of the distributor 20. The first flow passage 25 serves as a flow passage of the two-phase gas-liquid refrigerant, through which the refrigerant having flowed in through the inflow opening 34, which is the first inflow opening, flows upward. As shown in FIG. 6 and FIG. 7, at the position of the section along line B-B and the position of the section along line C-C, the recess 23, which partly defines a space of a second flow passage 27, and the groove 26, which forms a depression into which the flow passage wall 51*b* of the insertion part 51 is press-fitted, are formed in the columnar part 20*c*.

As shown in FIG. 6 and FIG. 7, at the position of the section along line B-B and the position of the section along line C-C, the flow passage wall 51*b* of the insertion part 51 is press-fitted in the groove 26. The flow passage wall 51*b* of the insertion part 51 is held from both sides by the side walls 26*e* of the groove 26, which face each other in the Y-axis direction. As shown in FIG. 6 and FIG. 7, at the position of the section along line B-B and the position of the section along line C-C, the space 21*b* surrounded by the flow passage wall 51*b* of the insertion part 51 and the recess 23 of the columnar part 20*c* is defined as the second flow passage 27. The second flow passage 27 is a flow passage formed by being surrounded by the flow passage wall 51*b*, which is the second planar part, and the third inner wall surface 20*c*3 of the main body 20*a*, and the refrigerant having flowed in through the inflow opening 34, which is the first inflow opening, flows upward through an inside of the second flow passage 27.

As shown in FIG. 7, at the position of the section along line C-C, the first flow passage 25 formed at the position of the section along line A-A shown in FIG. 5 and the position of the section along line B-B shown in FIG. 6 is blocked by the partition plane 51*a* and the flow passage wall 51*b* of the insertion part 51. On the other hand, at the position of the section along line C-C, only the second flow passage 27 is formed, so that the two-phase gas-liquid refrigerant moves to an upper part of the distributor 20 through the second flow passage 27. In the distributor 20, the partition plane 51*a* of the insertion part 51 prevents the two-phase gas-liquid refrigerant having flowed through the upper part of the distributor 20 from falling to a lower part of the distributor 20.

Figure 8:
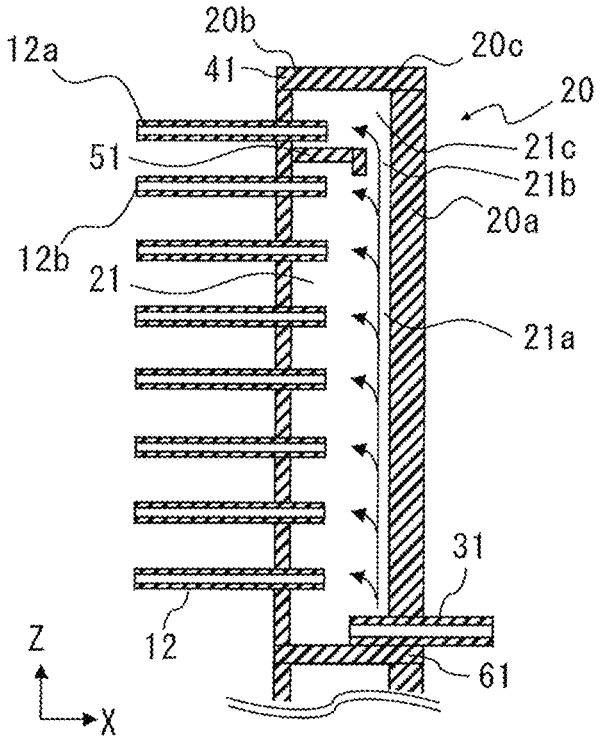
FIG. 8 is a vertical sectional view of the main body along line I-I shown in FIG. 5 to FIG. 7, in the extension direction of the main body as well as an extension direction of heat transfer tubes in which the heat transfer tubes extend.
Figure 9:
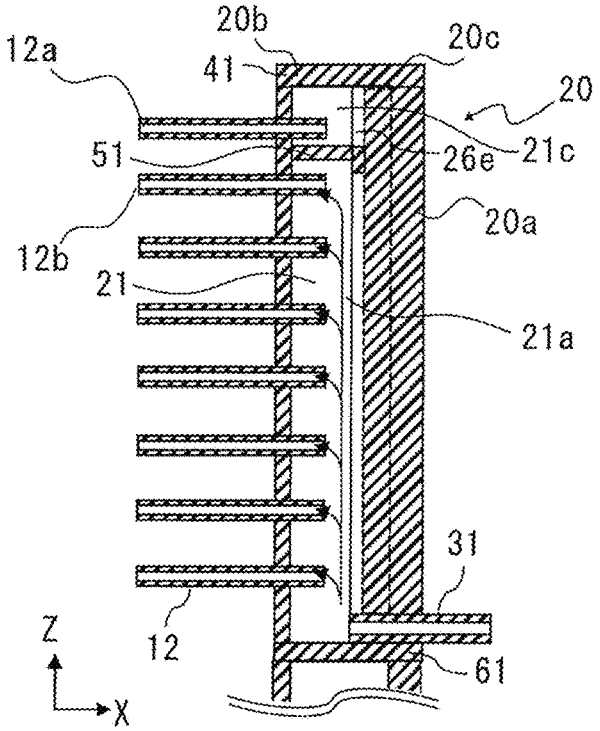
FIG. 9 is a vertical sectional view of the main body along line II-II shown in FIG. 5 to FIG. 7, in the extension direction of the main body as well as the extension direction of the heat transfer tubes.
Figure 10:
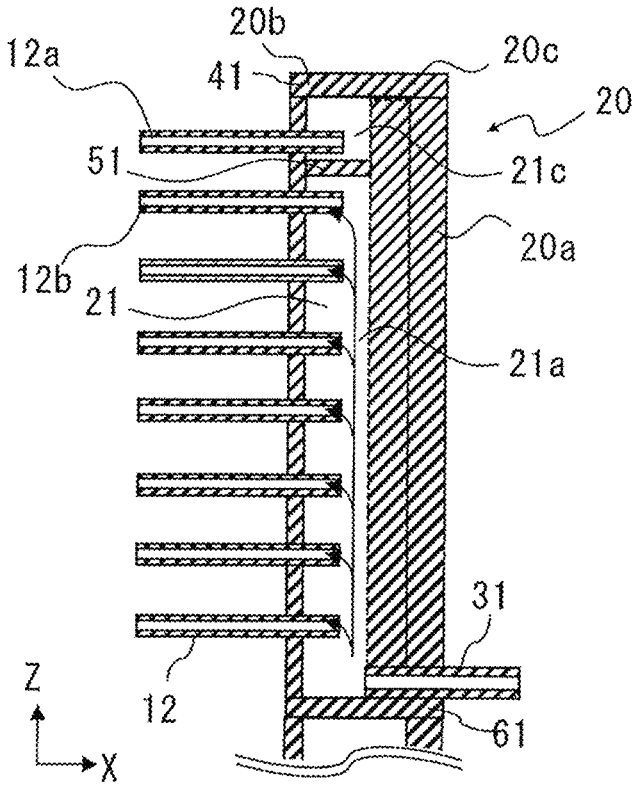
FIG. 10 is a vertical sectional view of the main body along line III-III shown in FIG. 5 to FIG. 7, in the extension direction of the main body as well as the extension direction of the heat transfer tubes.

FIG. 8 is a vertical sectional view of the main body 20*a* along line I-I shown in FIG. 5 to FIG. 7, in the extension direction of the main body 20*a* as well as the extension direction of the heat transfer tubes 12. FIG. 9 is a vertical sectional view of the main body 20*a* along line II-II shown in FIG. 5 to FIG. 7, in the extension direction of the main body 20*a* as well as the extension direction of the heat transfer tubes 12. FIG. 10 is a vertical sectional view of the main body 20*a* along line III-III shown in FIG. 5 to FIG. 7, in the extension direction of the main body 20*a* as well as the extension direction of the heat transfer tubes 12. A sectional view in the extension direction of the main body 20*a* as well as the extension direction of the heat transfer tubes 12 means sectional view represented by an X-Z plane.

The section along line I-I shows a section at a position passing the recess 23 of the columnar part 20*c*. The section along line II-II shows a section at a position passing the groove 26 at which the flow passage wall 51*b* of the insertion part 51 is press-fitted into the columnar part 20*c*. The section along line III-III shows a section at a position passing a part that does not involve the recess 23 and the groove 26 of the columnar part 20*c*.

How the two-phase gas-liquid refrigerant flows inside the distributor 20 at the position of the section along line I-I will be described with reference to FIG. 8 and FIG. 3. The arrows shown inside the distributor 20 in FIG. 8 and FIG. 3 show a flow of the two-phase gas-liquid refrigerant. The space 21*a* shown in FIG. 3 is a space of the space 21 below the insertion part 51, and the space 21*b* is a space of the space 21 located at the same level as the insertion part 51 and is a space between the insertion part 51 and the columnar part 20*c*. The space 21*c* is a space of the space 21 above the insertion part 51. The partition plane 51*a*, which is the first planar part, divides the space 21 inside the main body 20*a*, except for the second flow passage 27, into the space 21*c* above the partition plane 51*a*, which is the first planar part, and the space 21*a* below the partition plane 51*a*, Similarly, the space 22*a* is a space of the space 22 below the insertion part 52, and the space 22*b* is a space of the space 22 located at the same level as the insertion part 52 and is a space between the insertion part 52 and the columnar part 20*c*. The space 22*c* is a space of the space 22 above the insertion part 52. The partition plane 51*a*, which is the first planar part, divides the space 22 inside the main body 20*a*, except for the second flow passage 27, into the space 22*c* above the partition plane 51*a*, which is the first planar part, and the space 22*a* below the partition plane 51*a*.

In the space 21 of the upper main body 20*a*1 the two-phase gas-liquid refrigerant having flowed in through the inflow pipe 31 is sequentially discharged to the plurality of heat transfer tubes 12 connected to the frame-shaped part 20*b* while flowing vertically upward through the space 21*a* inside the distributor 20, so that the upward flow velocity decreases gradually. The space 21*a* defined by the frame-shaped part 20*b* and the columnar part 20*c* is the first flow passage 25, and the two-phase gas-liquid refrigerant having flowed in through the inflow pipe 31 flows through the first flow passage 25 when flowing vertically upward through the inside of the distributor 20.

The two-phase gas-liquid refrigerant flows through the space 21*b* after the flow passage cross-sectional area is reduced by the insertion part 51 at an upper part of the space 21*a* where the upward flow velocity decreases significantly. The space 21*b* defined by the flow passage wall 51*b* of the insertion part 51 and the recess 23 of the columnar part 20*c* is the second flow passage 27, and the two-phase gas-liquid refrigerant flows from below to above the insertion part 51 through the second flow passage 27. As the flow passage cross-sectional area is reduced, the two-phase gas-liquid refrigerant passing through the space 21*b* gains in upward flow velocity. Thus, separation between the gas refrigerant and the liquid refrigerant is prevented and the two-phase gas-liquid refrigerant moves to the upper part without the liquid refrigerant falling.

The two-phase gas-liquid refrigerant having passed through the space 21*b*, which is the second flow passage 27, flows through the first heat transfer tube 12*a* connected to the frame-shaped part 20*b* in the space 21*c*. In this case, since the space 21*c* is separated from the space 21*a* by the insertion part 51, the liquid refrigerant is prevented from falling even though the space 21*c* has a larger cross-sectional area than the space 21*b*.

Similarly, in the space 22 of the lower main body 20*a*2, the two-phase gas-liquid refrigerant having flowed in through the inflow pipe 32 is sequentially discharged to the plurality of heat transfer tubes 12 connected to the frame-shaped part 20*b* while flowing vertically upward through the space 22*a* inside the distributor 20, so that the upward flow velocity decreases gradually. The space 22*a* defined by the frame-shaped part 20*b* and the columnar part 20*c* is the first flow passage 25, and the two-phase gas-liquid refrigerant having flowed in through the inflow pipe 32 flows through the first flow passage 25 when flowing vertically upward through the inside of the distributor 20.

The two-phase gas-liquid refrigerant flows through the space 22*b* after the flow passage cross-sectional area is reduced by the insertion part 52 at an upper part of the space 22*a* where the upward flow velocity decreases significantly. The space 22*b* defined by the flow passage wall 51*b* of the insertion part 52 and the recess 23 of the columnar part 20*c* is the second flow passage 27, and the two-phase gas-liquid refrigerant flows from below to above the insertion part 52 through the second flow passage 27. As the flow passage cross-sectional area is reduced, the two-phase gas-liquid refrigerant passing through the space 22*b* gains in upward flow velocity. Thus, separation between the gas refrigerant and the liquid refrigerant is prevented and the two-phase gas-liquid refrigerant moves to the upper part without the liquid refrigerant falling.

The two-phase gas-liquid refrigerant having passed through the space 22*b*, which is the second flow passage 27, flows through the heat transfer tube 12 connected to the frame-shaped part 20*b* in the space 22*c*. In this case, since the space 22*c* is separated from the space 22*a* by the insertion part 52, the liquid refrigerant is prevented from falling even though the space 22*c* has a larger crass-sectional area than the space 22*b*.

As shown in FIG. 3 and FIG. 8, the distributor 20 causes the two-phase gas-liquid refrigerant to split and flow into eight heat transfer tubes 12 while the two-phase gas-liquid refrigerant passes through the second flow passage 27. Thus, the distributor 20 causes the two-phase gas-liquid refrigerant to split and flow into eight heat transfer tubes 12 in the vicinity of a central part of the distributor 20 in the Y-axis direction where the recess 23 is formed.

Next, how the two-phase gas-liquid refrigerant flows inside the distributor 20 at the position of the section along line II-II and the position of the section along line III-III will be described with reference to FIG. 3, FIG. 9, and FIG. 10. At the position of the section along line II-II and the position of the section along line III-III of the upper main body 20*a*1, the space 21*b* serving as a part of the second flow passage 27 is not defined inside the distributor 20, and the first flow passage 25 is divided by the insertion part 51 into the space 21*a* and the space 21*c*. Therefore, at the position of the section along line II-II and the position of the section along line III-III where the recess 23 is not formed, the distributor 20 causes the two-phase gas-liquid refrigerant to split and flow into seven heat transfer tubes 12 located below the insertion part 51. In the upper main body 20*a*1 of the distributor 20, the two-phase gas-liquid refrigerant flowing into the heat transfer tube 12 located at the highest part thus passes through the second flow passage 27 shown in the section along line I-I, The main body 20*a* is formed such that the refrigerant flowing upward through the second flow passage 27 while communicating with the first flow passage 25 communicates with the first heat transfer tube 12*a*.

Similarly, at the position of the section along line II-II and the position of the section along line III-III of the lower main body 20*a*2, the space 22*b* serving as a part of the second flow passage 27 is not defined inside the distributor 20, and the first flow passage 25 is divided by the insertion part 52 into the space 21*a* and the space 21*c*. Therefore, at the position of the section along line II-II and the position of the section along line III-III where the recess 23 is not formed, the distributor 20 causes the two-phase gas-liquid refrigerant to split and flow into seven heat transfer tubes 12 located below the insertion part 52. In the lower main body 20*a*2 of the distributor 20, the two-phase gas-liquid refrigerant flowing into the heat transfer tube 12 located at the highest part thus passes through the second flow passage 27 shown in the section along line I-I.

Figure 11:
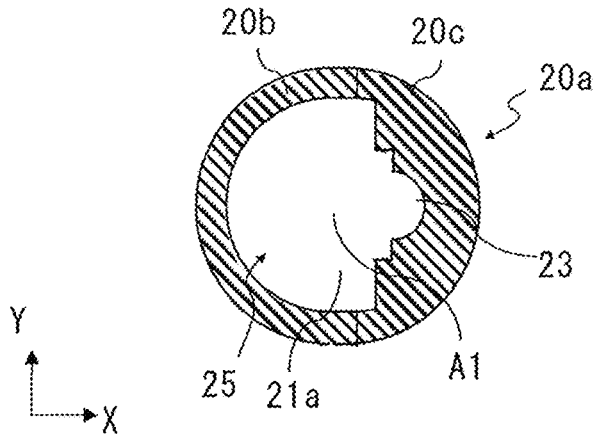
FIG. 11 is a sectional view perpendicular to the extension direction of the main body, at a position where the heat transfer tube is not inserted.
Figure 12:
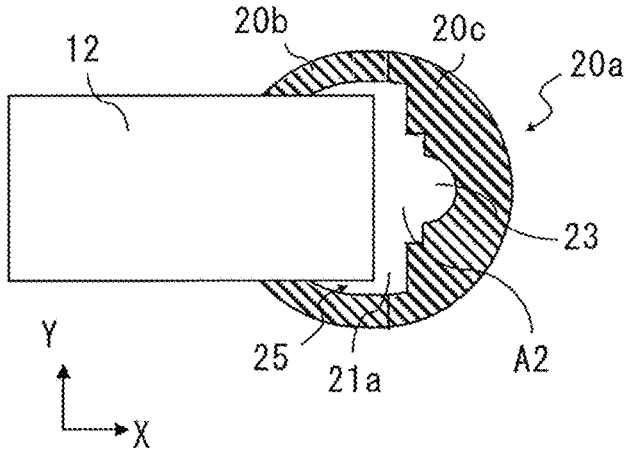
FIG. 12 is a sectional view perpendicular to the extension direction of the main body, at a position where the heat transfer tube is inserted.
Figure 13:
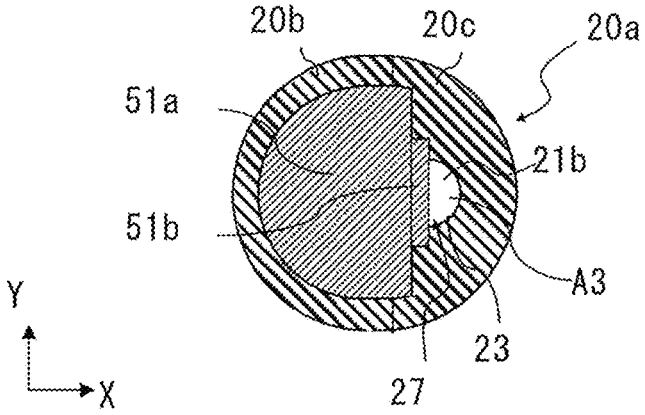
FIG. 13 is a sectional view perpendicular to the extension direction of the main body, at a position where an insertion part is inserted.

FIG. 11 is a sectional view perpendicular to the extension direction of the main body 20*a*, at a position where the heat transfer tube 12 is not inserted. FIG. 12 is a sectional view perpendicular to the extension direction of the main body 20*a*, at a position where the heat transfer tube 12 is inserted. FIG. 13 is a sectional view perpendicular to the extension direction of the main body 20*a*, at a position where the insertion part 51 is inserted. Next, with reference to FIG. 11 and FIG. 12, a concept will be described about the cross-sectional areas of the first flow passage 25 formed by the frame-shaped part 20*b* and the columnar part 20*c* and the second flow passage 27 formed by the insertion part 51 or the insertion part 52 and the columnar part 20*c* when Embodiment 1 is applied.

The flow passage cross-sectional areas of the first flow passage 25 and the second flow passage 27 shown in FIG. 11 to FIG. 13 will be defined as follows. The cross-sectional area of the first flow passage 25 at the position where the heat transfer tube 12 is not inserted is a first flow passage cross-sectional area A1 [$m^2$], the cross-sectional area of the first flow passage 25 at the position where the heat transfer tube 12 is inserted is a first flow passage cross-sectional area A2 [$m^2$], and the cross-sectional area of the second flow passage 27 is a second flow passage cross-sectional area A3 [$m^2$]. At the position where the heat transfer tube 12 is inserted, the heat transfer tube 12 protrudes into the space 21 or the space 22 of the main body 20*a*, and an end of the heat transfer tube 12 is disposed in the space 21 or the space 22 of the main body 20*a*. The cross-sectional area of the first flow passage 25 of the main body 20*a* is reduced by the protruding heat transfer tube 12.

As shown in FIG. 11 to FIG. 13, the first flow passage cross-sectional area A1 [$m^2$] is larger than the first flow passage cross-sectional area A2 [$m^2$], and the first flow passage cross-sectional area A2 [$m^2$] is larger than the second flow passage cross-sectional area. A3 [$m^2$]. The flow passages inside the distributor 20 are formed to satisfy the following condition: first flow passage cross-sectional area A1 [$m^2$]>first flow passage cross-sectional area A2 [$m^2$]>second flow passage cross-sectional area A3 [$m^2$]. As shown by the first flow passage cross-sectional area A1 [$m^2$], the first flow passage cross-sectional area A2 [$m^2$], and the second flow passage cross-sectional area A3 [$m^2$] of FIG. 11 to FIG. 13, the distributor 20 is formed such that the cross-sectional area of the flow passage through which the two-phase gas-liquid refrigerant flows changes with the position in the longitudinal direction (Z-axis direction).

The following values will be defined as follows: the length of the perimeter of the first flow passage cross-sectional area A1 is a wetted perimeter length L [m] of the first flow passage 25 at the position where the heat transfer tube 12 is not inserted, and the length of the perimeter of the first flow passage cross-sectional area A2 is a wetted perimeter length L2 [m] of the first flow passage 25 at the position where the heat transfer tube 12 is inserted, the length of the perimeter of the second flow passage cross-sectional area A3 is a wetted perimeter length L3 [m] of the second flow passage 27, a hydraulic power-equivalent diameter of the first flow passage cross-sectional area A1 is D [m], a hydraulic power-equivalent diameter of the first flow passage cross-sectional area A2 is D2 [m], a hydraulic power-equivalent diameter of the second flow passage cross-sectional area A3 is D3 [m], an amount of circulation of the two-phase gas-liquid refrigerant flowing through the first flow passage 25 or the second flow passage 27 is Gr [kg/s], the quality is x [−], the density is ρ [$kg/m^3$], and the apparent velocity is u [m/s]. In this case, a non-dimensional flooding velocity j* [−] and a flooding constant C [−] are calculated by the following formulae.

[Expression 1]

$$C = j_L^{*\,0.5} + j_G^{*\,0.5} \tag{1}$$

[Expression 2]

$$j_G^* = u_G\left(\frac{\rho_G}{gD_N(\rho_L - \rho_G)}\right)^{0.5} \tag{2}$$

[Expression 3]

$$j_L^* = u_L\left(\frac{\rho_L}{gD_N(\rho_L - \rho_G)}\right)^{0.5} \tag{3}$$

[Expression 4]

$$u_G = \frac{Gr \cdot x}{\rho_G \cdot A_N} \tag{4}$$

[Expression 5]

$$u_L = \frac{Gr \cdot (1 - x)}{\rho_L \cdot A_N} \tag{5}$$

[Expression 6]

$$D = \frac{4 \cdot A_N}{L_N} \tag{6}$$

Suffix [_N]:$N$ = 1 or 2 or 3, suffix [_G]:gas, and suffix [_L]:liquid.

When the flooding constant C2 [−] in the first flow passage cross-sectional area A2 falls below 0.5, separation between the gas refrigerant and the liquid refrigerant is likely to occur. Therefore, the insertion part 51 or the insertion part 52 needs to be installed at a position inside the distributor 20 at which the refrigerant has a flow velocity with the flooding constant C2 [−] of higher than or equal to 0.5 in the first flow passage 25, and it is preferable that the second flow passage 27 be set such that the flooding constant C3 [−] of 1.0 or higher is secured.

Figure 14:
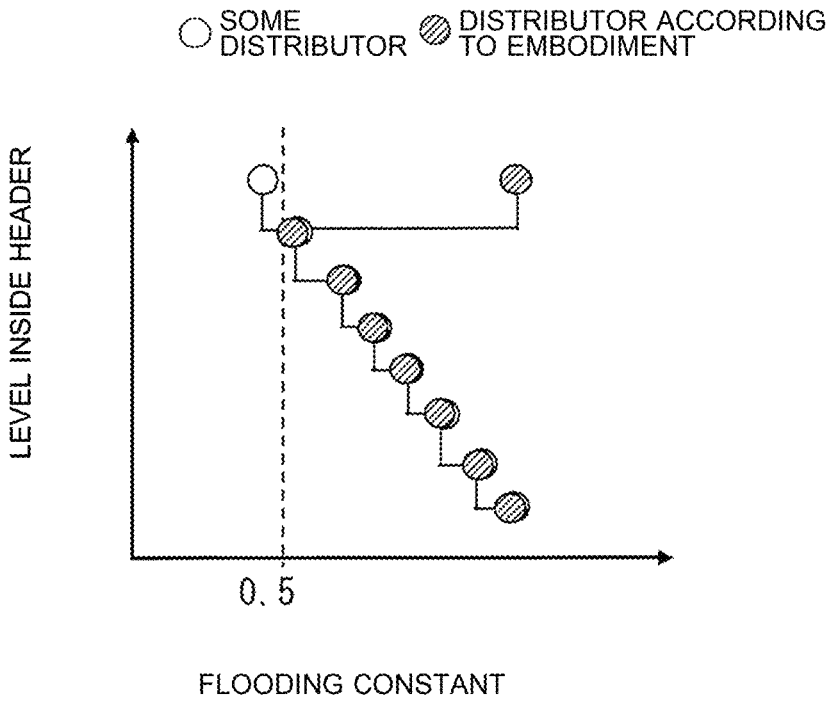
FIG. 14 is a graph showing a relationship of a flooding constant with a level inside a header.

FIG. 14 is a graph showing a relationship of the flooding constant with the level inside the header. As shown in FIG. 14, as the level inside the header rises, the two-phase gas-liquid refrigerant is sequentially discharged to the heat transfer tubes 12 and therefore the flooding constant decreases. As a result, in the case of some distributor, the flooding constant falls below 0.5 at the highest part inside the header and separation between the gas refrigerant and the liquid refrigerant occurs, so that only the gas refrigerant is supplied to the highest part inside the header.

In the distributor 20 according to Embodiment 1, by contrast, the flooding constant of the two-phase gas-liquid refrigerant passing through the second flow passage 27 is set to be higher than a flooding constant of some distributor, which prevents separation between the gas refrigerant and the liquid refrigerant, Therefore, the distributor 20 according to Embodiment 1 is configured to supply the liquid refrigerant also to the heat transfer tube 12 at the upper part of the distributor 20 where the liquid refrigerant tends to be insufficient. As a result, the distributor 20 of the heat exchanger 50 is configured to evenly supply the gas refrigerant and the liquid refrigerant to the heat exchange unit 50*a* located downstream of the distributor 20, and thereby improves the refrigerant distribution performance.

Since the insertion part 51 and the insertion part 52 are each provided between two heat transfer tubes 12 and in the recess 23 of the columnar part 20*c*, the space of the first flow passage 25 defined by the frame-shaped part 20*b* and the columnar part 20*c* is kept down to a minimum possible volume required to insert the heat transfer tubes 12. Further, since the insertion part 51 and the insertion part 52 are each provided between two heat transfer tubes 12 and in the recess 23 of the columnar part 20*c* and the space of the first flow passage 25 is thus minimized to the extent possible, the flooding constant is increased.

The distributor 20 according to Embodiment 1 has the main body 20*a* in which the insertion part 51 is disposed. The main body 20*a* has the second flow passage 27, which is surrounded by the flow passage wall 51*b*, which is the second planar part, and the third inner wall surface 20*c*3 of the main body 20*a*, and through which the refrigerant having flowed in through the inflow opening 34, which is the first inflow opening, flows upward. In the main body 20*a*, the refrigerant flowing upward through the second flow passage 27 while communicating with the first flow passage 25 communicates with the first heat transfer tube 12*a*, which is an upper one of two arbitrary heat transfer tubes 12 among the plurality of heat transfer tubes 12 arrayed in the up-down direction, That is, the refrigerant having passed through the first flow passage 25 and the second flow passage 27 flows through the first heat transfer tube 12*a*, and the refrigerant having passed through the first flow passage 25 flows through the second heat transfer tube 12*b*. Thus, the insertion part 51 allows the heat exchanger 50 to evenly distribute the refrigerant in the longitudinal direction of the main body 20*a* of the distributor 20 (Z-axis direction) and thereby improve the refrigerant distribution performance. The distributor 20 according to Embodiment 1 makes it possible to reduce the size of the main body 20*a* of the distributor 20 to a minimum possible required size while improving uneven distribution of two-phase gas-liquid refrigerant toward even distribution through the use of the low-cost insertion part 51 or insertion part 52 alone. In addition, the distributor 20 according to Embodiment 1 contributes to reducing the material cost and the installation space of the distributor 20.

The main body 20*a* has the plurality of connection openings 33, which are made at intervals in the up-down direction and through which the plurality of heat transfer tubes 12 are inserted, and at least one recess 23 that has a shape of a groove extending in the up-down direction and is formed at the position facing the plurality of connection openings 33. Therefore, the main body 20*a* has the first flow passage 25 partly defined by the main body 20*a* and the second flow passage 27 partly defined by the recess 23 of the main body 20*a*. As a result, the refrigerant is supplied to the heat transfer tube 12 disposed at the upper part of the main body 20*a* by using the insertion part 51. Thus, the insertion part 51 allows the heat exchanger 50 to evenly distribute the refrigerant in the longitudinal direction of the main body 20*a* of the distributor 20 (Z-axis direction) and thereby improve the refrigerant distribution performance.

The main body 20*a* has the lid 41 and the lid 42 that close both ends of the main body 20*a* in the longitudinal direction (Z-axis direction) and thus define the internal space in the main body 20*a*. As the lid 41 and the lid 42 are provided, the main body 20*a* has its internal space separated from an external space. This makes it possible to form the first flow passage 25 and the second flow passage 27 in the internal space of the main body 20*a* through the use of the insertion part 51.

The inflow opening 34, which is the first inflow opening, is made at the position facing one of the plurality of heat transfer tubes 12 that is located at the lowest part of the internal space of the main body 20*a*. Alternatively, the inflow opening 34, which is the first inflow opening, is made at a lower position than a position of the one of the plurality of heat transfer tubes 12 that is located at the lowest part of the internal space of the main body 20*a*. In a case where the inflow opening 34 is made at a position between two heat transfer tubes 12 in the space 21*a* or the space 22*a*, an upward flow and a downward flow of the refrigerant are generated, so that the flow velocity for sending the two-phase gas-liquid refrigerant upward decreases. A decrease in the flow velocity for sending the two-phase gas-liquid refrigerant upward causes the gas refrigerant and the liquid refrigerant to be easily separated from each other. Forming the inflow opening 34, which is the first inflow opening, at the above-described position, creates an upward flow of the two-phase gas-liquid refrigerant without creating a downward flow of the two-phase gas-liquid refrigerant.

The main body 20*a* has a shape of a tube formed by a combination of the frame-shaped part 20*b*, which is the first part into which the heat transfer tubes 12 are inserted, and the columnar part 20*c*, which is the second part having the first inflow openings. Since the main body 20*a* is composed of these parts, the main body 20*a* is easily produced by, for example, pressing.

The partition plane 51*a*, which is the first planar part, divides the space inside the main body 20*a*, except for the second flow passage 27, into the space above the partition plane 51*a*, which is the first planar part, and the space below the partition plane 51*a*. In the distributor 20, the partition plane 51*a* of the insertion part 51 prevents the two-phase gas-liquid refrigerant having flowed through the upper part of the distributor 20 from falling to the lower part of the distributor 20.

The main body 20*a* is installed in the state where the central axis in the longitudinal direction (Z-axis direction) is oriented vertically or where the central axis in the longitudinal direction is inclined within a range within which the central axis in the longitudinal direction has a vertical vector component. The distributor 20 of the heat exchanger 50 according to Embodiment 1 avoids excessively supplying a liquid to the upper part of the distributor 20 or other distributor to which the flow rate is excessively high.

Embodiment 2

Figure 15:
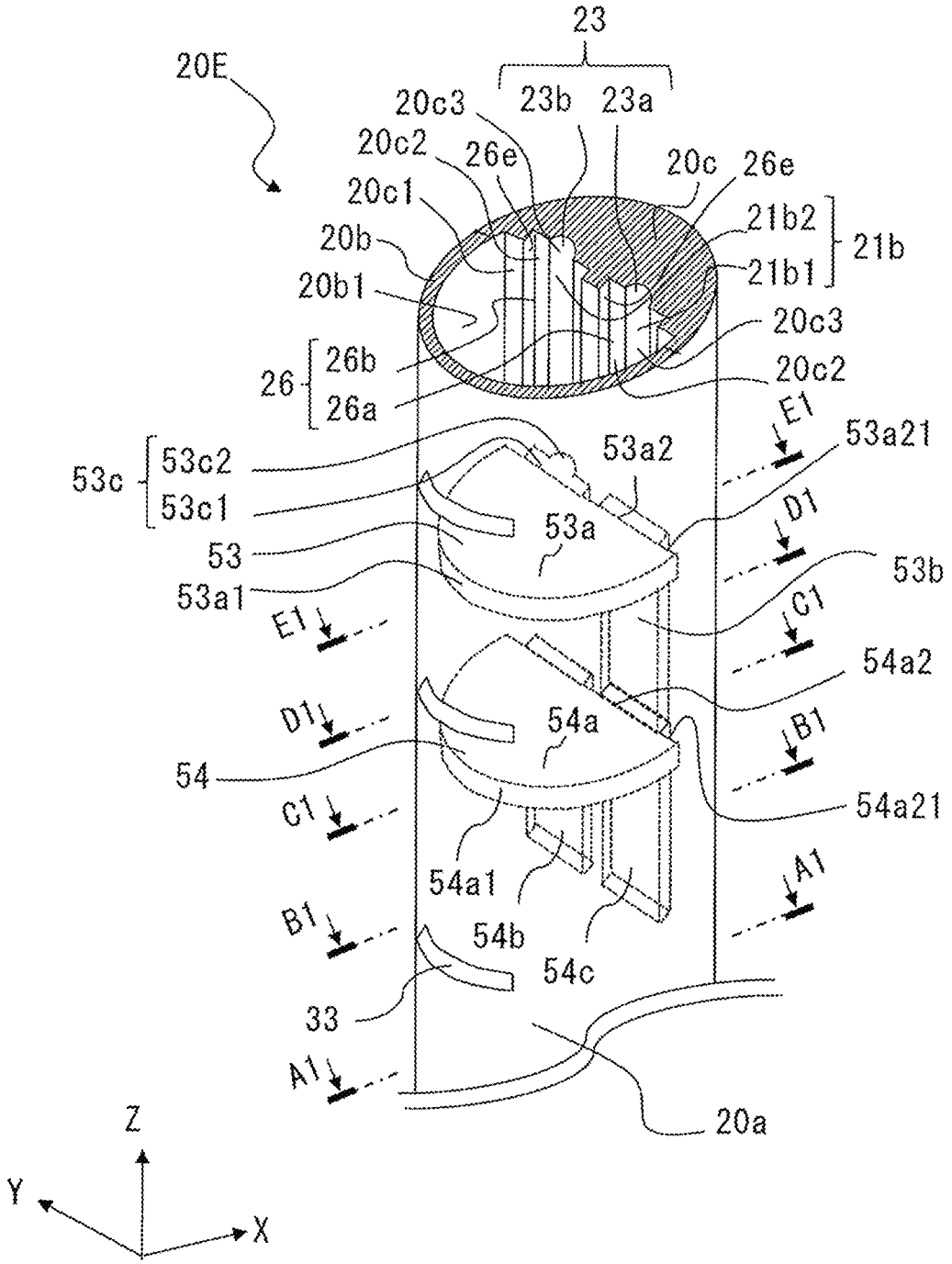
FIG. 15 is a perspective view of a distributor according to Embodiment 2.

FIG. 15 is a perspective view of a distributor 20E according to Embodiment 2. In FIG. 15, depiction of the lid 41 is omitted to illustrate the internal structure of the distributor 20E. Those components that have the same function and workings as in the distributor 20 according to Embodiment 1 will be denoted by the same reference signs and their description will be omitted. In the distributor 20 according to Embodiment 1, a flow passage of the two-phase gas-liquid refrigerant other than the first flow passage 25 is provided at only one location as the second flow passage 27, whereas in the distributor 20E according to Embodiment 2, flow passages other than the first flow passage 25 are formed at least at two locations. Thus, in the distributor 20 according to Embodiment 2, the number of flow passages to supply the two-phase gas-liquid refrigerant to an upper part of the distributor 20E is larger than the number of such flow passages in the distributor 20 according to Embodiment 1. Hereinafter, the distributor 20E according to Embodiment 2 will be described with a focus on differences from the distributor 20 according to Embodiment 1.

The columnar part 20*c*, which is a part of the main body 20*a*, has the groove 26 and the recess 23. The groove 26 is a groove formed in the inner wall surface 20*c*1 of the columnar part 20*c* and forms the second inner wall surface 20*c*2 recessed from the inner wall surface 20*c*1. The groove 26 is formed by the side walls 26*e* facing each other in the Y-axis direction and the second inner wall surface 20*c*2. The groove 26 is formed along the longitudinal direction of the main body 20*a* (Z-axis direction). The columnar part 20*c* has the groove 26 at two locations that are formed as a first groove 26*a* and a second groove 26*b*. "Groove 26" is a collective term for the first groove 26*a* and the second groove 26*b*.

The first groove 26*a* and the second groove 26*b* are formed adjacently side by side in the Y-axis direction. The first groove 26*a* and the second groove 26*b* are formed along the longitudinal direction of the columnar part 20*c* (Z-axis direction). The first groove 26*a* and the second groove Mb have the same basic structure in that they each have a groove shape and each have the recess 23. The first groove 26*a* and the second groove 26*b* are equal in the width in the Y-axis direction. However, the configuration of the first groove 26*a* and the second groove 26*b* is not limited to the one in which they are equal in the width in the Y-axis direction. The first groove 26*a* and the second groove 26*b* may have different widths in the Y-axis direction because of the sizes of a flow passage wall 53*b*, a flow passage wall 54*b*, and a flow passage wall 54*c*, to be described later, that are press-fitted into the first groove 26*a* and the second groove 26*b*, or other sizes.

The groove 26 has the recess 23 with a groove shape. In a side view seen from the direction perpendicular to the longitudinal direction of the main body 20*a* (Z-axis direction), the width of the groove 26 in the Y-axis direction is larger than the maximum width of the recess 23 in the Y-axis direction. The recess 23 is formed along the longitudinal direction of the main body 20*a* (Z-axis direction), The recess 23 is formed along the extension direction of the groove 26. The recess 23 forms the third inner wall surface 20*c*3 recessed from the second inner wall surface 20*c*2. The third inner wall surface 20*c*3 is formed as a curved shape, and has an arc shape in a plan view seen from the direction parallel to the longitudinal direction of the main body 20*a* (Z-axis direction). The recess 23 has a first recess 23*a* and a second recess 23*b* that each have a shape of a groove, are formed next to each other, and extend along the longitudinal direction of the main body 20*a* (Z-axis direction), "Recess 23" is a collective term for the first recess 23*a* and the second recess 23*b*.

The first recess 23*a* and the second recess 23*b* are formed adjacently side by side in the Y-axis direction. The first recess 23*a* and the second recess 23*b* are formed along the longitudinal direction of the columnar part 20*c* (Z-axis direction). The first recess 23*a* and the second recess 23*b* have the same basic structure in that they each have an arc shape in a plan view and each have a shape of a groove extending along the longitudinal direction of the columnar part 20*c* (Z-axis direction). The first recess 23*a* and the second recess 23*b* are equal in the width in the Y-axis direction and the depth in the X-axis direction. However, the configuration of the first recess 23*a* and the second recess 23*b* is not limited to the one in which they are equal in the width in the Y-axis direction. The configuration of the first recess 23*a* and the second recess 23*b* is also not limited to the one in which they are equal in the depth in the X-axis direction, (Insertion Part 53 and Insertion Part 54)

An insertion part 53 and an insertion part 54 disposed inside the main body 20*a* will be described with reference to FIG. 15. While the insertion part 53 and the insertion part 54 mounted in the upper main body 20*a*1 will be described in the following description, the insertion part 53 and the insertion part 54 are mounted in each of the upper main body 20*a*1 and the lower main body 20*a*2. Alternatively, the insertion part 53 and the insertion part 54 may be mounted in only one of the upper main body 20*a*1 and the lower main body 20*a*2. The insertion part 53 and the insertion part 54 each have the same basic structure as the insertion part 51 having the partition plane 51*a* and the flow passage wall 51*b*, Inside the main body 20*a*, the insertion part 53 and the insertion part 54 are adjacently arrayed in the up-down direction. In this case, the insertion part 53 is disposed above the insertion part 54, and the insertion part 54 is disposed under the insertion part 53.

(Insertion Part 53)

The insertion part 53 has a partition plane 53*a* that contacts the frame-shaped part 20*b* and the columnar part 20*c*, the flow passage wall 53*b*, which contacts the columnar part 20*c*, and a closing part 53*c* that contacts the columnar part 20*c*. The partition plane 53*a*, the flow passage wall 53*b*, and the closing part 53*c* are formed as one part but may instead be formed as separate parts. In the distributor 20E, the partition plane 53*a* is a first planar part and the flow passage wall 53*b* is a second planar part.

The partition plane 53*a*, which is the first planar part, divides the space inside the main body 20*a*, except for the second flow passage 27, into a space above the partition plane 53*a*, which is the first planar part, and a space below the partition plane 53*a*. The partition plane 53*a* is a plate-shaped part perpendicular to the longitudinal direction of the main body 20*a* (Z-axis direction), As shown in FIG. 15, the partition plane 53*a* having a plate shape forms an X-Y plane. The partition plane 53*a* has a semicircular shape in a plan view seen from the direction parallel to the longitudinal direction of the main body 20*a* (Z-axis direction). The partition plane 53*a* is disposed between two of the plurality of connection openings 33 made in the longitudinal direction of the frame-shaped part 20*b* (Z-axis direction), Thus, in the longitudinal direction of the main body 20*a* (Z-axis direction), the partition plane 53*a* is disposed between two heat transfer tubes 12, which are inserted through the connection openings 33.

The partition plane 53*a* is a plate-shaped part, and has a curved part 53*a*1 that has an arc shape in a plan view seen from the direction parallel to the longitudinal direction of the main body 20*a* (Z-axis direction) and a straight part 53*a*2 that is provided between both ends of the curved part 53*a*1 and has a straight shape in the plan view. The curved part 53*a*1 forms a curve that is convex and opposite to a position at which the columnar part 20*c* is disposed. The straight part 53*a*2 extends in the Y-axis direction. In the partition plane 53*a*, the curved part 53*a*1 forms a side wall having a curved surface and the straight part 53*a*2 forms a side wall having a flat surface. However, the shape of the curved part 53*a*1 is not limited to an arc shape in a plan view seen from the direction parallel to the longitudinal direction of the main body 20*a* (Z-axis direction) but may instead be, for example, an arch shape or a horseshoe shape.

When the insertion part 53 is disposed inside the main body 20*a*, the curved part 53*a*1 contacts the inner wall surface 20*b*1 of the frame-shaped part 20*b*. The straight part 53*a*2 is connected to an upper end portion of the flow passage wall 53*b*. In a plan view seen from the direction parallel to the longitudinal direction of the main body 20*a* (Z-axis direction), the flow passage wall 53*b* protrudes from the straight part 53*a*2. In a plan view seen from the direction parallel to the longitudinal direction of the main body 20*a* (Z-axis direction), the width of the partition plane 53*a* in the Y-axis direction is larger than the width of the flow passage wall 53*b*.

The flow passage wall 53*b* is a plate-shaped part extending in the longitudinal direction of the main body 20*a* (Z-axis direction), In a side view seen from the direction perpendicular to the longitudinal direction of the main body 20*a* (Z-axis direction), the flow passage wall 53*b* has a rectangular shape. As shown in FIG. 15, the flow passage wall 53*b* having a plate shape forms a Y-Z plane. Thus, the flow passage wall 53*b* has a quadrangular prism shape. In the Y-axis direction, the flow passage wall 53*b* is formed at a position located off from the vicinity of the center of the straight part 53*a*2 toward one end, and extends downward from the straight part 53*a*2. The flow passage wall 53*b* is formed at a position facing the groove 26 when the insertion part 53 is disposed inside the main body 20*a*. More specifically, the flow passage wall 53*b* is formed at a position facing the first groove 26*a* or the second groove 26*b* when the insertion part 53 is disposed inside the main body 20*a*.

The insertion part 53 is mounted inside the main body 20*a* as the flow passage wall 53*b* is press-fitted into the groove 26. Therefore, when the insertion part 53 is disposed inside the main body 20*a*, the flow passage wall 53*b* is disposed in the groove 26 of the columnar part 20*c*. When the insertion part 53 is disposed inside the main body 20*a*, the flow passage wall 53*b* is disposed in the groove 26 of the columnar part 20*c* and the space 21*b* is thus defined by the recess 23.

More specifically, when the insertion part 53 is disposed inside the main body 20*a*, the flow passage wall 53*b* is disposed in the first groove 26*a* of the columnar part 20*c* and the space 21*b*1 is thus defined by the first recess 23*a*. At this time, the flow passage wall 53*b* contacts the flow passage wall 54*c* of the insertion part 54, to be described later, in the longitudinal direction of the main body 20*a* (Z-axis direction) and thus forms a wall extending continuously in the longitudinal direction of the main body 20*a* (Z-axis direction).

Alternatively, when the insertion part 53 is disposed inside the main body 20*a*, the flow passage wall 53*b* is disposed in the second groove 26*b* of the columnar part 20*c* and the space 21*b*2 is thus defined by the second recess 23*b*. At this time, the flow passage wall 53*b* contacts the flow passage wall 54*b* of the insertion part 54, to be described later, in the longitudinal direction of the main body 20*a* (Z-axis direction) and thus forms a wall extending continuously in the longitudinal direction of the main body 20*a* (Z-axis direction).

In a plan view seen from the direction parallel to the longitudinal direction of the main body 20*a* (Z-axis direction), the closing part 53*c* protrudes from the straight part 53*a*2. In a plan view seen from the direction parallel to the longitudinal direction of the main body 20*a* (Z-axis direction), the width of the partition plane 53*a* in the Y-axis direction is larger than the width of the closing part 53*c*. Contact portions 53*a*21 of the straight part 53*a*2 on which the flow passage wall 53*b* and the closing part 53*c* are not formed contact the inner wall surface 20*c*1 of the columnar part 20*c* when the insertion part 53 is disposed inside the main body 20*a*.

The closing part 53*c* has such a shape as to engage with the groove 26 and the recess 23, and is shaped to fit into the groove 26 and the recess 23 when the insertion part 53 is disposed inside the main body 20*a*, Therefore, the closing part 53*c* has a groove closing portion 53*c*1 that has a quadrangular shape to engage with the groove 26 and a recess closing portion 53*c*2 that is shaped to engage with the recess 23. The recess closing portion 53*c*2 is only required to have such a semicylindrical shape as to engage with the recess 23. However, the shape of the recess closing portion 53*c*2 is not limited to a semicylindrical shape but may be any shape that allows the recess closing portion 53*c*2 to engage with the recess 23. The closing part 53*c* forms a first planar part together with the partition plane 53*a*. Thus, the closing part 53*c* forms an X-Y plane together with the partition plane 53*a*.

The closing part 53*c* and the flow passage wall 53*b* b are formed on the straight part 53*a*2 adjacently side by side in the Y-axis direction. In the Y-axis direction, the closing part 53*c* is formed at a position located off from the vicinity of the center of the straight part 53*a*2 toward the other end. The closing part 53*c* is formed at a position facing the groove 26 when the insertion part 53 is disposed inside the main body 20*a*. More specifically, the closing part 53*c* is formed at a position facing the first groove 26*a* or the second groove 26*b* when the insertion part 53 is disposed inside the main body 20*a*.

When the insertion part 53 is disposed inside the main body 20*a* the closing part 53*c* is disposed in the groove 26 and the recess 23 of the columnar part 20*c*. When the insertion part 53 is disposed inside the main body 20*a*, the closing part 53*c* is disposed in the groove 26 and the recess 23 of the columnar part 20*c*, so that the third flow passage 28 or the second flow passage 27 is closed, More specifically, when the insertion part 53 is disposed inside the main body 20*a*, the closing part 53*c* is disposed in the second groove 26*b* and the second recess 23*b* of the columnar part 20*c* and closes the space 21*b*2 of the second recess 23*b*. Alternatively, when the insertion part 53 is disposed inside the main body 20*a*, the closing part 53*c* is disposed in the first groove 26*a* and the first recess 23*a* of the columnar part 20*c* and closes the space 21*b*1 of the first recess 23*a*.

(Insertion Part 54)

The insertion part 54 has a partition plane 54*a* that contacts the frame-shaped part 20*b* and the columnar part 20*c*, and the flow passage wall 54*b* and the flow passage wall 54*c*, which contact the columnar part 20*c*. The partition plane 54*a* and the flow passage wall 54*b* and the flow passage wall 54*c* are formed as one part but may instead be formed as separate parts. In the distributor 20E, the partition plane 54*a* is a first planar part, the flow passage wall 54*b* is a second planar part, and the flow passage wall 54*c* is a third planar part.

The partition plane 54*a*, which is the first planar part, divides the space inside the main body 20*a*, except for the second flow passage 27 and the third flow passage 28, into a space above the partition plane 54*a*, which is the first planar part, and a space below the partition plane 54*a*. The partition plane 54*a* is a plate-shaped part perpendicular to the longitudinal direction of the main body 20*a* (Z-axis direction). As shown in FIG. 15, the partition plane 54*a* having a plate shape forms an X-Y plane. In a plan view seen from the direction parallel to the longitudinal direction of the main body 20*a* (Z-axis direction), the partition plane 54*a* has a semicircular shape. The partition plane 54*a* is disposed between two of the plurality of connection openings 33, which are made in the longitudinal direction of the frame-shaped part 20*b* (Z-axis direction). Thus, in the longitudinal direction of the main body 20*a* (Z-axis direction), the partition plane 54*a* is disposed between two heat transfer tubes 12, which are inserted through the connection openings 33.

The partition plane 54*a* is a plate-shaped part, and has a curved part 54*a*1 that has an arc shape in a plan view seen from the direction parallel to the longitudinal direction of the main body 20*a* (Z-axis direction) and a straight part 54*a*2 that is provided between both ends of the curved part 54*a*1 and has a straight shape in the plan view. The curved part 54*a*1 forms a curve that is convex and opposite to a position at which the columnar part 20*c* is disposed. The straight part 54*a*2 extends in the Y-axis direction. In the partition plane 54*a*, the curved part 54*a*1 forms a side wall having a curved surface and the straight part 54*a*2 forms a side wall having a flat surface. However, the shape of the curved part 54*a*1 is not limited to an arc shape in a plan view seen from the direction parallel to the longitudinal direction of the main body 20*a* (Z-axis direction) but may instead be, for example, an arch shape or a horseshoe shape.

When the insertion part 54 is disposed inside the main body 20*a*, the curved part 54*a*1 contacts the inner wall surface 20*b*1 of the frame-shaped part 20*b*. The straight part 54*a*2 is connected to upper end portions of the flow passage wall 54*b* and the flow passage wall 54*c*. In a plan view seen from the direction parallel to the longitudinal direction of the main body 20*a* (Z-axis direction), the flow passage wall 54*b* and the flow passage wall 54*c* protrude from the straight part 54*a*2. In a plan view seen from the direction parallel to the longitudinal direction of the main body 20*a* (Z-axis direction), the width of the partition plane 54*a* in the Y-axis direction is larger than the widths of the flow passage wall 54*b* and the flow passage wall 54*c*. When the insertion part 54 is disposed inside the main body 20*a*, contact portions

54*a*21 of the straight part 54*a*2 on which the flow passage wall 54*b* and the flow passage wall 54*c* are not formed contact the inner wall surface 20*c*1 of the columnar part 20*c*.

The flow passage wall 54*b* and the flow passage wall 54*c* are plate-shaped parts extending in the longitudinal direction of the main body 20*a* (Z-axis direction). In a side view seen from the direction perpendicular to the longitudinal direction of the main body 20*a* (Z-axis direction), the flow passage wall 54*b* and the flow passage wall 54*c* each have a rectangular shape. As shown in FIG. 15, the flow passage wall 54*b* and the flow passage wall 54*c* each having a plate shape form a Y-Z plane. Thus, the flow passage wall 54*b* and the flow passage wall 54*c* each have a quadrangular prism shape.

In the Y-axis direction, the flow passage wall 54*b* is formed at a position located off from the vicinity of the center of the straight part 54*a*2 toward one end, and is formed to extend downward from the straight part 54*a*2. The flow passage wall 54*b* is formed at a position facing the groove 26 when the insertion part 54 is disposed inside the main body 20*a*. More specifically, the flow passage wall 54*b* is formed at a position facing the second groove 26*b* when the insertion part 54 is disposed inside the main body 20*a*.

In the Y-axis direction, the flow passage wall 54*c* is formed at a position located off from the vicinity of the center of the straight part 54*a*2 toward the other end, and is formed to extend downward from the straight part 54*a*2. The flow passage wall 54*c* is formed at a position facing the groove 26 when the insertion part 54 is disposed inside the main body 20*a*. More specifically, the flow passage wall 54*c* is formed at a position facing the first groove 26*a* when the insertion part 54 is disposed inside the main body 20*a*.

The flow passage wall 54*b* and the flow passage wall 54*c* are formed on the straight part 54*a*2 adjacently side by side in the Y-axis direction. The flow passage wall 54*b* and the flow passage wall 54*c* each have a quadrangular prism shape and have the same basic structure. The flow passage wall 54*b* and the flow passage wall 54*c* are equal in the width in the Y-axis direction. However, the configuration of the flow passage wall 54*b* and the flow passage wall 54*c* is not limited to the one in which they are equal in the width in the Y-axis direction. The flow passage wall 54*b* and the flow passage wall 54*c* may have different widths in the Y-axis direction because of the width dimensions of the first groove 26*a* and the second groove 26*b*, which the flow passage wall 54*c* and the flow passage wall 54*b* respectively face. The flow passage wall 54*b* and the flow passage wall 54*c* are equal in the length in the longitudinal direction of the main body 20*a* (Z-axis direction). However, the configuration of the flow passage wall 54*b* and the flow passage wall 54*c* is not limited to the one in which they are equal in the length in the longitudinal direction of the main body 20*a* (Z-axis direction).

The insertion part 54 is mounted inside the main body 20*a* as the flow passage wall 54*b* and the flow passage wall 54*c* are press-fitted into the groove 26. Therefore, when the insertion part 54 is disposed inside the main body 20*a*, the flow passage wall 54*b* is disposed in the second groove 26*b* of the columnar part 20*c* and the flow passage wall 54*c* is disposed in the first groove 26*a* of the columnar part 20*c*. When the insertion part 54 is disposed inside the main body 20*a*, the flow passage wall 54*b* and the flow passage wall 54*c* are disposed in the groove 26 of the columnar part 20*c* and the space 21*b* is thus defined by the recess 23.

More specifically, when the insertion part 54 is disposed inside the main body 20*a*, the flow passage wall 54*b* is disposed in the second groove 26*b* of the columnar part 20*c* and the space 21*b*2 is thus defined by the second recess 23*b*. When the insertion part 54 is disposed inside the main body 20*a*, the flow passage wall 54*c* is disposed in the first groove 26*a* of the columnar part 20*c* and the space 21*b*1 is thus defined by the first recess 23*a*. At this time, the flow passage wall 54*b* or the flow passage wall 54*c* contacts the flow passage wall 53*b* of the insertion part 53 in the longitudinal direction of the main body 20*a* (Z-axis direction) and thus forms a wall that extends continuously in the longitudinal direction of the main body 20*a* (Z-axis direction).

For example, the insertion part 54 and the insertion part 54 are each formed into an L-shape as a flat plate with a thickness of about 1 mm is bent by pressing. By thus pressing a flat plate, the partition plane 53*a* forming an X-Y plane and the flow passage wall 53*b* forming a Y-Z plane are formed in the insertion part 53. Similarly, by thus pressing a flat plate, the partition plane 54*a* forming an X-Y plane and the flow passage wall 54*b* and the flow passage wall 54*c* forming Y-Z planes are formed in the insertion part 54.

The insertion part 53 composed of the partition plane 53*a* and the flow passage wall 53*b* has a small volume and is easy to produce. Therefore, the material cost and the production cost of the insertion part 53 are lower than those of some insertion part, which allows the distributor 20 and the heat exchanger 50 to be produced at low costs. Similarly, the insertion part 54 composed of the partition plane 54*a*, the flow passage wall 54*b*, and the flow passage wall 54*c* has a small volume and is easy to produce. Therefore, the material cost and the production cost of the insertion part 54 are lower than those of some insertion part, which allows the distributor 20 and the heat exchanger 50 to be produced at low costs.

Further, the insertion part 53 is mounted on the main body 20*a* by press-fitting the flow passage wall 53*b* into the groove 26 of the columnar part 20*c*, This allows a worker to easily mount the insertion part 53 on the main body 20*a* and thereby facilitates the production of the distributor 20E and the heat exchanger 50. Similarly, the insertion part 54 is mounted on the main body 20*a* by press-fitting the flow passage wall 54*b* and the flow passage wall 54*c* into the grooves 26 of the columnar part 20*c*. This allows a worker to easily mount the insertion part 54 on the main body 20*a* and thereby facilitates the production of the distributor 20 and the heat exchanger 50.

Figure 16:
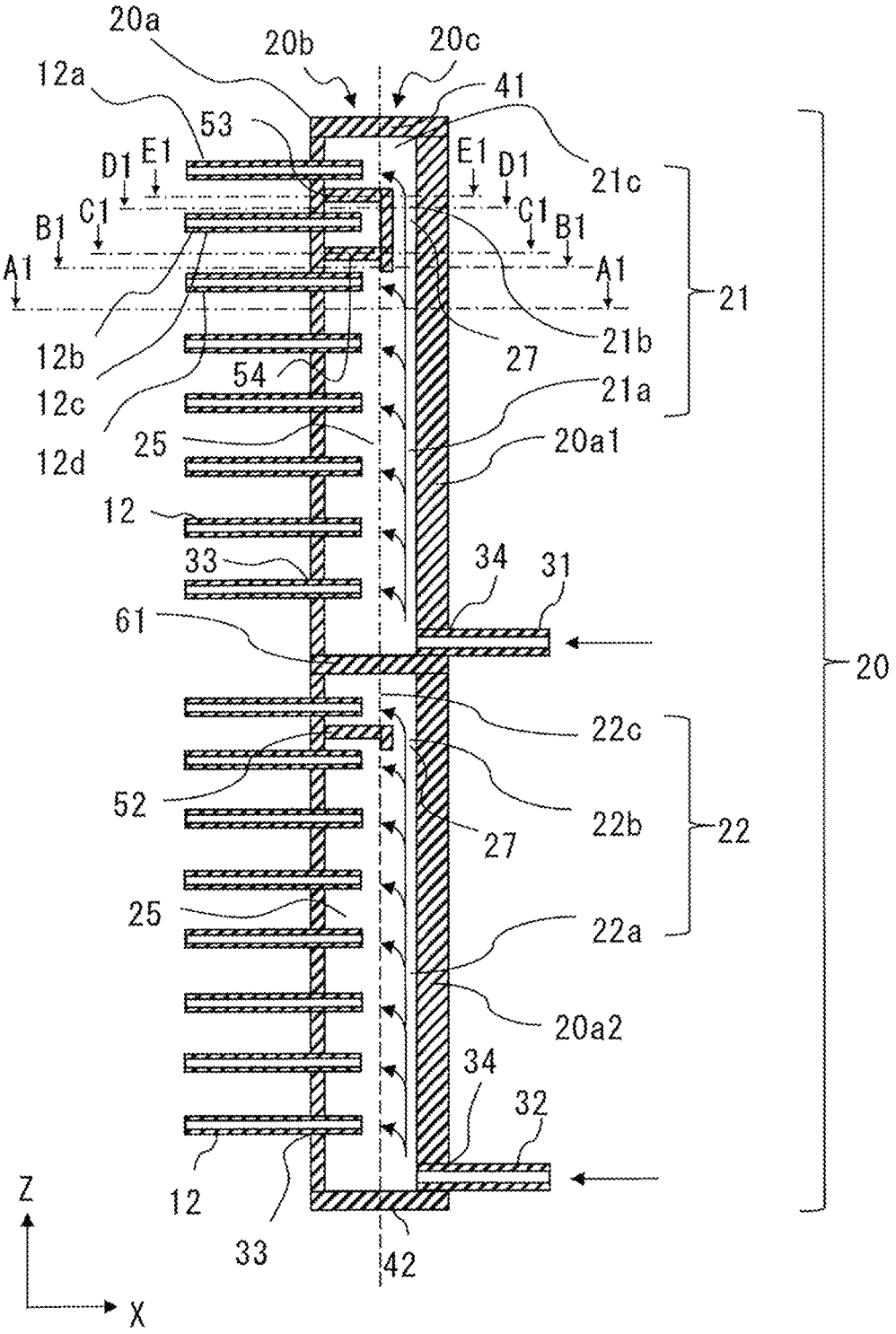
FIG. 16 is a conceptual diagram showing a vertical section of the distributor according to Embodiment 2.
Figure 17:
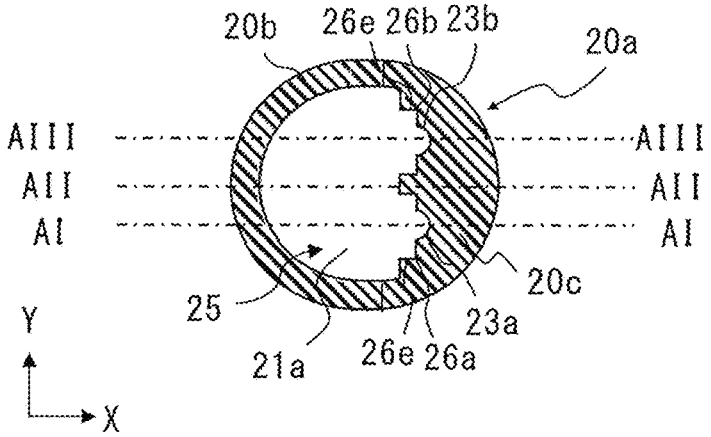
FIG. 17 is a sectional view along, line A1-A1 shown in FIG. 15 and FIG. 16, perpendicular to the extension direction of the main body.
Figure 18:
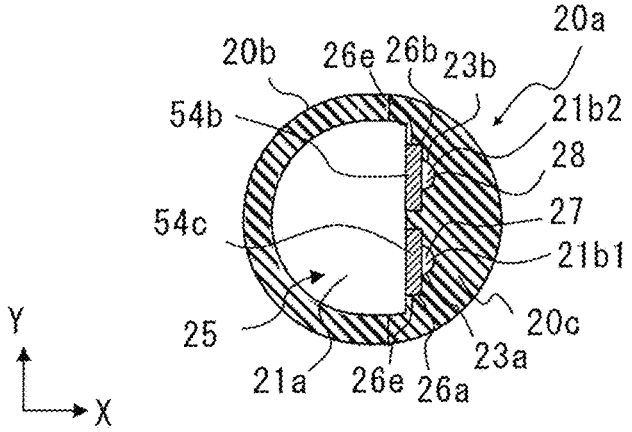
FIG. 18 is a sectional view along line B1-B1 shown in FIG. 15 and FIG. 16, perpendicular to the extension direction of the main body.
Figure 19:
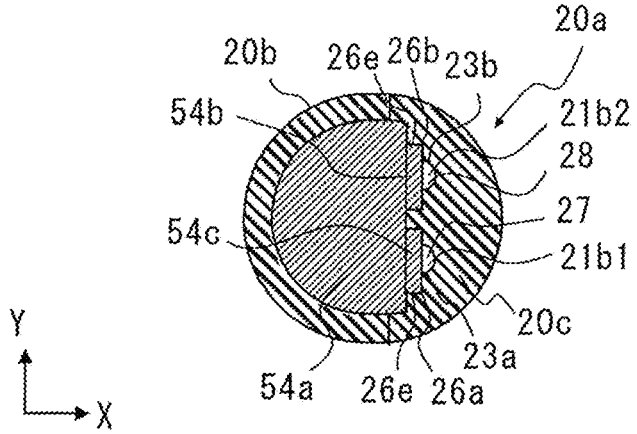
FIG. 19 is a sectional view along line C1-C1 shown in FIG. 15 and FIG. 16, perpendicular to the extension direction of the main body.
Figure 20:
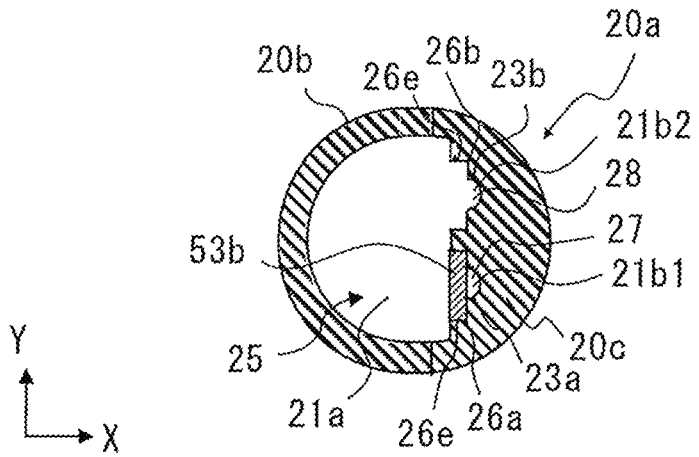
FIG. 20 is a sectional view along line D1-D1 shown in FIG. 15 and FIG. 16, perpendicular to the extension direction of the main body.
Figure 21:
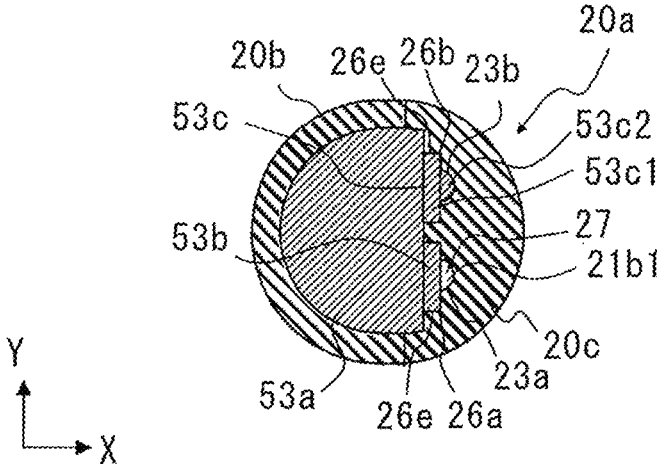
FIG. 21 is a sectional view along line E1-E1 shown in FIG. 15 and FIG. 16, perpendicular to the extension direction of the main body.

FIG. 16 is a conceptual diagram showing a vertical section of the distributor 20E according to Embodiment 2. FIG. 17 is a sectional view along line A1-A1 shown in FIG. 15 and FIG. 16, perpendicular to the extension direction of the main body 20*a*. FIG. 18 is a sectional view along line B1-B1 shown in FIG. 15 and FIG. 16, perpendicular to the extension direction of the main body 20*a*. FIG. 19 is a sectional view along line C1-C1 shown in FIG. 15 and FIG. 16, perpendicular to the extension direction of the main body 20*a*. FIG. 20 is a sectional view along line D1-D1 shown in FIG. 15 and FIG. 16, perpendicular to the extension direction of the main body 20*a*. FIG. 21 is a sectional view along line E1-E1 shown in FIG. 15 and FIG. 16, perpendicular to the extension direction of the main body 20*a*.

For the section of the distributor 20E at the position of line A1-A1 shown in FIG. 17, a section at a position that does not involve the insertion part 53 and the insertion part 54 is shown. For the section of the distributor 20E at the position of line B1-B1 shown in FIG. 18, a section at a position that involves the flow passage wall 54*b* and the flow passage wall 54*c* of the insertion part 54 is shown. For the section of the distributor 20E at the position of line C1-C1 shown in FIG. 19, a section at a position that involves the partition plane 54*a* of the insertion part 54 is shown. For the section of the distributor 20E at the position of line D1-D1 shown in FIG. 20, a section at a position that involves the flow passage wall 53*b* of the insertion part 53 is shown. For the section of the distributor 20E at the position of line E1-E1 shown in FIG. 21, a section at a position that involves the partition plane 53*a* of the insertion part 53 is shown.

As shown in FIG. 17 and FIG. 18, at the position of the section along line A1-A1 and the position of the section along line B1-B1, the space 21*a* surrounded by the frame-shaped part 20*b* and the columnar part 20*c* is defined as the first flow passage 25 in the main body 20*a* of the distributor 20E. The first flow passage 25 serves as a flow passage of the two-phase gas-liquid refrigerant. As shown in FIG. 18 and FIG. 19, at the position of the section along line B1-B1 and the position of the section along line C1-C1, the second recess 23*b*, which partly defines the space of the third flow passage 28, and the second groove 26*b*, which forms a depression into which the flow passage wall 54*b* of the insertion part 54 is press-fitted, are formed in the columnar part 20*c*. Further, as shown in FIG. 18 and FIG. 19, at the position of the section along line B1-B1 and the position of the section along line C1-C1, the first recess 23*a*, which partly defines the space of the second flow passage 27, and the first groove 26*a* that, which forms a depression into which the flow passage wall 54*c* of the insertion part 54 is press-fitted, are formed in the columnar part 20*c*.

As shown in FIG. 18 and FIG. 19, at the position of the section along line B1-B1 and the position of the section along line C1-C1, the flow passage wall 54*b* of the insertion part 54 is press-fitted in the second groove 26*b*. The flow passage wall 54*b* of the insertion part 54 is held from both sides by the side walls 26*e* of the groove 26, which face each other in the Y-axis direction. As shown in FIG. 18 and FIG. 19, at the position of the section along line B1-B1 and the position of the section along line C1-C1, the space 21*b*2 surrounded by the flow passage wall 54*b* of the insertion part 54 and the second recess 23*b* of the columnar part 20*c* is defined as the third flow passage 28.

As shown in FIG. 18 and FIG. 19, at the position of the section along line B1-B1 and the position of the section along line C1-C1, the flow passage wall 54*c* of the insertion part 54 is press-fitted in the first groove 26*a*. The flow passage wall 54*c* of the insertion part 54 is held from both sides by the side walls 26*e* of the groove 26, which face each other in the Y-axis direction. As shown in FIG. 18 and FIG. 19, at the position of the section along line B1-B1 and the position of the section along line C1-C1, the space 21*b*1 surrounded by the flow passage wall 54*c* of the insertion part 54 and the first recess 23*a* of the columnar part 20*c* is defined as the second flow passage 27.

As shown in FIG. 19, at the position of the section along line C1-C1, the first flow passage 25, which is formed at the position of the section along line A1-A1 in FIG. 17 and the position of the section along line B1-B1 in FIG. 18, is blocked by the partition plane 54*a*, the flow passage wall 54*b*, and the flow passage wall 54*c* of the insertion part 54. On the other hand, at the position of the section along line C1-C1, only the second flow passage 27 and the third flow passage 28 are formed, so that the two-phase gas-liquid refrigerant moves to an upper part of the distributor 20E through the second flow passage 27 and the third flow passage 28. In the distributor 20E, the partition plane 54*a* of the insertion part 54 prevents the two-phase gas-liquid refrigerant having flowed through the upper part of the distributor 20E from falling to a lower part of the distributor 20E.

As shown in FIG. 20 and FIG. 21, at the position of the section along line D1-D1 and the position of the section along line E1-E1, the second groove 26*b* and the second recess 23*b* are formed. Further, as shown in FIG. 20 and FIG. 21, at the position of the section along line D1-D1 and the position of the section along line E1-E1, the first recess 23*a*, which partly defines the space of the second flow passage 27, and the first groove 26*a*, which forms a depression into which the flow passage wall 53*b* of the insertion part 53 is press-fitted are formed in the columnar part 20*c*.

As shown in FIG. 20 and FIG. 21, at the position of the section along line D1-D1 and the position of the section along line E1-E1, the flow passage wall 53*b* of the insertion part 53 is press-fitted in the first groove 26*a*. The flow passage wall 53*b* of the insertion part 53 is held from both sides by the side walls 26*e* of the first groove 26*a*, which face each other in the Y-axis direction. As shown in FIG. 20 and FIG. 21, at the position of the section along line D1-D1 and the position of the section along line E1-E1, the space 21*b*1 surrounded by the flow passage wall 53*b* of the insertion part 53 and the first recess 23*a* of the columnar part 20*c* is defined as the second flow passage 27. In a case where the flow passage wall 53*b* and the closing part 53*c* are formed at reversed positions in the Y-axis direction, the flow passage wall 53*b* of the insertion part 53 may be press-fitted into the second groove 26*b*. In this case, the flow passage wall 53*b* of the insertion part 53 is held from both sides by the side walls 26*e* of the second groove 26*b*, which face each other in the Y-axis direction. The space 21*b*2 surrounded by the flow passage wall 53*b* of the insertion part 53 and the second recess 23*b* of the columnar part 20*c* is defined as the third flow passage 28.

At the position of the section along line D1-D1, the space 21*b*2 of the third flow passage 28 is defined as a part of the first flow passage 25. Therefore, the two-phase gas-liquid refrigerant flowing in through the third flow passage 28 formed by the insertion part 54 and the columnar part 20*c* flows toward the frame-shaped part 20*b* having the connection openings 33.

As shown in FIG. 21, at the position of the section along line E1-E1, the closing part 53*c* of the insertion part 53 is fitted in the second groove 26*b* and the second recess 23*b*. As shown in FIG. 21, at the position of the section along line E1-E1, the closing part 53*c* of the insertion part 53 closes the third flow passage 28. In a case where the flow passage wall 53*b* and the closing part 53*c* are formed at reversed positions in the Y-axis direction, the closing part 53*c* of the insertion part 53 is fitted in the first groove 26*a* and the first recess 23*a*. In this case, the closing part 53*c* of the insertion part 53 closes the second flow passage 27.

As shown in FIG. 21, at the position of the section along line E1-E1, the first flow passage 25, which is formed at the position of the section along line D1-D1 in FIG. 20, is blocked by the partition plane 53*a*, the flow passage wall 53*b*, and the closing part 53*c* of the insertion part 53. Thus, at the position of the section along line E1-E1, part of the space 21 is closed by the partition plane 53*a*, the flow passage wall 53*b*, and the closing part 53*c* of the insertion part 53. At the position of the section along line E1-E1, only the second flow passage 27 is formed as the flow passage through which the refrigerant flows, so that the two-phase gas-liquid refrigerant moves to the upper part of the distributor 20E through the second flow passage 27. In the distributor 20E, the partition plane 53*a* of the insertion part 53 prevents the two-phase gas-liquid refrigerant having flowed through the upper part of the distributor 20E from falling to the lower part of the distributor 20E.

As the insertion part 53 and the insertion part 54 are provided, the distributor 20E according to Embodiment 2 is configured to supply the two-phase gas-liquid refrigerant to the heat transfer tube 12 disposed at the highest part of the main body 20*a* through the second flow passage 27. Moreover, as the insertion part 53 and the insertion part 54 are provided, the distributor 20E according to Embodiment 2 is configured to supply the two-phase gas-liquid refrigerant to the heat transfer tube 12 that is disposed at a position immediately below the highest part of the main body 20*a* through the third flow passage 28.

Figure 22:
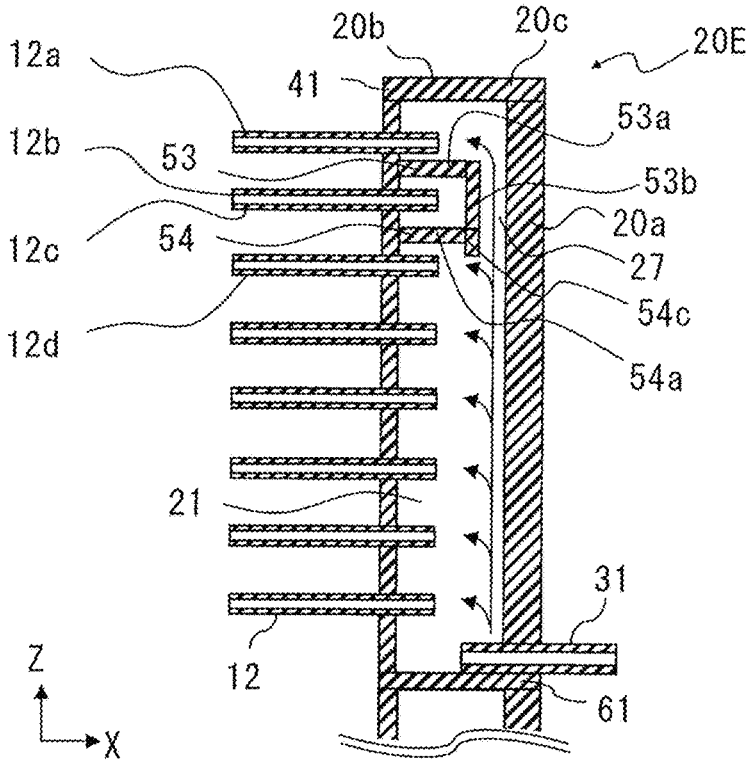
FIG. 22 is a vertical sectional view of the main body along line A1-A1 shown in FIG. 17, in the extension direction of the main body as well as the extension direction of the heat transfer tubes.
Figure 23:
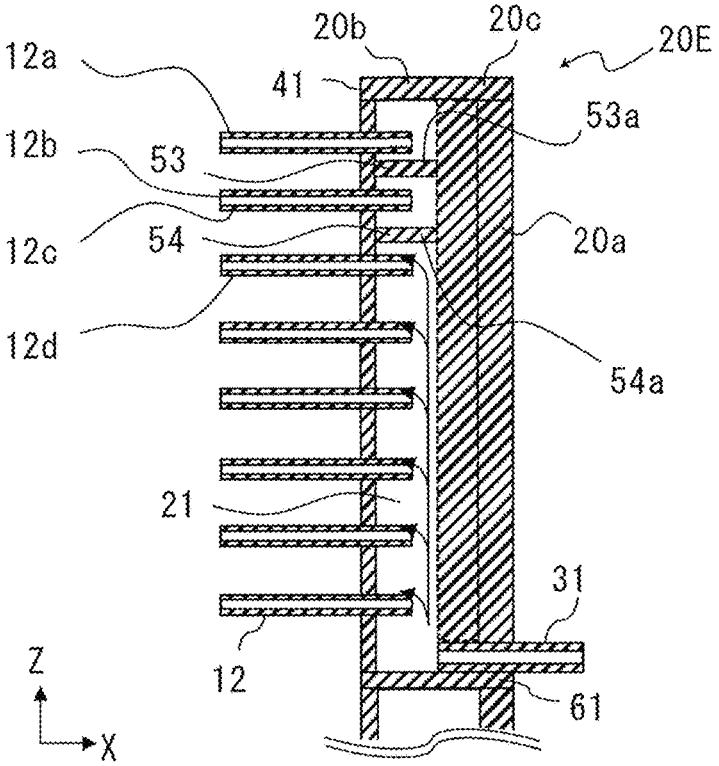
FIG. 23 is a vertical sectional view of the main body along line AII-AII shown in FIG. 17, in the extension direction of the main body as well as the extension direction of the heat transfer tubes.
Figure 24:
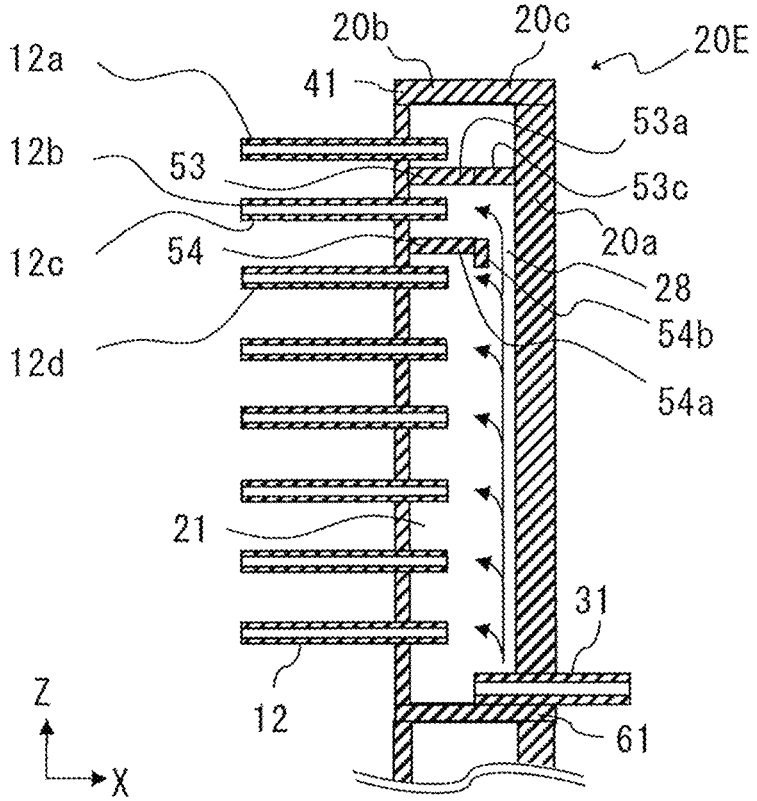
FIG. 24 is a vertical sectional view of the main body along line AIII-AIII shown in FIG. 17, in the extension direction of the main body as well as the extension direction of the heat transfer tubes.

FIG. 22 is a vertical sectional view of the main body 20*a* along line AI-AI shown in FIG. 17, in the extension direction of the main body 20*a* as well as the extension direction of the heat transfer tubes 12. FIG. 23 is a vertical sectional view of the main body 20*a* along line AII-AII shown in FIG. 17, in the extension direction of the main body 20*a* as well as the extension direction of the heat transfer tubes 12. FIG. 24 is a vertical sectional view of the main body 20*a* along line AIII-AIII shown in FIG. 17, in the extension direction of the main body 20*a* as well as the extension direction of the heat transfer tubes 12. A sectional view in the extension direction of the main body 20*a* as well as the extension direction of the heat transfer tubes 12 means a sectional view represented by an X-Z plane. The arrows shown inside the distributor 20E in FIG. 22 to FIG. 24 show a flow of the two-phase gas-liquid refrigerant.

The section along line AI-AI shows a section at a position passing the first recess 23*a* partly forming the second flow passage 27 of the columnar part 20*c*. The section along line AII-AII shows a section at a position passing a part that does not involve the recess 23 of the columnar part 20*c*. The section along line AIII-AIII shows a section at a position passing the second recess 23*b* partly forming the third flow passage 28 of the columnar part 20*c*.

As shown in FIG. 22 to FIG. 24, an upper one and a lower one of two arbitrary heat transfer tubes 12 among the plurality of heat transfer tubes 12 arrayed in the up-down direction will be referred to as the first heat transfer tube 12*a* and the second heat transfer tube 12*b*, respectively. An upper one and a lower one of two arbitrary heat transfer tubes 12 among the plurality of heat transfer tubes 12 that are located below the first heat transfer tube 12*a* will be referred to as a third heat transfer tube 12*c* and a fourth heat transfer tube 12*d*, respectively. The insertion part has the insertion part 53, which is a first insertion part installed between the first heat transfer tube 12*a* and the second heat transfer tube 12*b*, and the insertion part 54, which is a second insertion part installed between the third heat transfer tube 12*c* and the fourth heat transfer tube 12*d*. The insertion part 53, which is the first insertion part, has the partition plane 53*a*, which is the first planar part, and faces the first heat transfer tube 12*a* and the second heat transfer tube 12*b*. The insertion part 53, which is the first insertion part, further has the flow passage wall 53*b*, which is the second planar part. The flow passage wall 53*b*, which is the second planar part, faces the wall surface of the main body 20*a* and defines the space 21*b*1 between the flow passage wall 53*b* and the first recess 23*a*. The space 21*b*1 serves as the second flow passage 27 through which the refrigerant having flowed in through the inflow opening 34, which is the first inflow opening, flows upward. The insertion part 54, which is the second insertion part, has the partition plane 54*a*, which is the first planar part, and faces the third heat transfer tube 12*c* and the fourth heat transfer tube 12*d*. The insertion part 54, which is the second insertion part, further has the flow passage wall 54*b*, which is the second planar part. The flow passage wall 54*b*, which is the second planar part, faces the wall surface of the main body 20*a* and defines the space 21*b*2 serving as the third flow passage 28 between the flow passage wall 54*b* and the second recess 23*b*. The insertion part 54, which is the second insertion part, further has the flow passage wall 54*c*, which is the third planar part. The flow passage wall 54*c*, which is the third planar part, is formed parallel to the wall surface of the main body 20*a* and defines the space 21*b*1 serving as the second flow passage 27 between the flow passage wall 54*c* and the first recess 23*a*. The main body 20*a* is formed such that the refrigerant flowing upward through the third flow passage 28 while communicating with the first flow passage 25 communicates with the second heat transfer tube 12*b*, and that the refrigerant flowing upward through the second flow passage 27 while communicating with the first flow passage 25 communicates with the first heat transfer tube 12*a*. That is, the refrigerant having passed through the first flow passage 25 and the second flow passage 27 flows through the first heat transfer tube 12*a*, and the refrigerant having passed through the first flow passage 25 and the third flow passage 28 flows through the second heat transfer tube 12*b*.

Of eight branch flows of the two-phase gas-liquid refrigerant, six branch flows from the bottom move sequentially toward the plurality of heat transfer tubes 12 provided in the longitudinal direction of the main body 20*a* (Z-axis direction). Thus, the two-phase gas-liquid refrigerant having flowed into the main body 20*a* of the distributor 20E flows sequentially into the heat transfer tubes 12, up to the sixth one from the bottom, among the eight heat transfer tubes 12 provided in the longitudinal direction of the main body 20*a* (Z-axis direction).

At the position shown by the section along line AI-AI, the two-phase gas-liquid refrigerant is supplied to the heat transfer tube 12 disposed at the highest part of the distributor 20 through the second flow passage 27. At the position shown by the section along line AIII-AIII, the two-phase gas-liquid refrigerant is supplied to the heat transfer tube 12 disposed at the position immediately below the highest part of the distributor 20 through the third flow passage 28. Thus, at the position shown by the section along line AI-AI, the distributor 20E includes a refrigerant path for supplying the two-phase gas-liquid refrigerant to the heat transfer tube 12 disposed at the highest part of the distributor 20 through the second flow passage 27. At the position shown by the section along line AIII-AIII, the distributor 20E includes a refrigerant path for supplying the two-phase gas-liquid refrigerant to the heat transfer tube 12 disposed at the position immediately below the highest part of the distributor 20 through the third flow passage 28.

Note that, as in the distributor 20 according to Embodiment 1, the cross-sectional areas of the second flow passage 27 and the third flow passage 28 should be set such that a flooding constant of 1.0 or higher is secured. The form of the distributor 20E according to Embodiment 2 in which the recess 23 is formed at two locations in the columnar part 20*c* as the first recess 23*a* and the second recess 23*b* has been shown. Alternatively, the number of refrigerant flow passages for supplying the two-phase gas-liquid refrigerant to the upper part of the distributor 20E may be increased by additionally forming a recess 23 in the columnar part 20*c*, at a position other than the positions where the first recess 23*a* and the second recess 23*b* are formed, or in the frame-shaped part 20*b*.

The distributor 20E according to Embodiment 2 has the main body 20*a* in which the insertion part 53 and the insertion part 54 are disposed. In the main body 20*a*, the refrigerant flowing upward through the third flow passage 28 while communicating with the first flow passage 25 communicates with the second heat transfer tube 12*b*, and the refrigerant flowing upward through the second flow passage 27 while communicating with the first flow passage 25 communicates with the first heat transfer tube 12*a*. That is, the refrigerant having passed through the first flow passage 25 and the second flow passage 27 flows through the first heat transfer tube 12*a*, and the refrigerant having passed through the first flow passage 25 and the third flow passage a flows through the second heat transfer tube 12*b*. Thus, in the distributor 20E according to Embodiment 2, paths for supplying the two-phase gas-liquid refrigerant to the upper part of the distributor 20E are provided at least at two locations by using the insertion part 53 and the insertion part 54. Therefore, the distributor 20E according to Embodiment 2 smoothly leads the two-phase gas-liquid refrigerant to the upper part of the distributor 20 where the velocity of the two-phase gas-liquid refrigerant rising inside the distributor 20E tends to decrease, and thereby produces a greater improving effect on even distribution of the refrigerant than the distributor 20 according to Embodiment 1. The insertion part 53 and the insertion part 54 are produced at a low cost.

Embodiment 3

Figure 25:
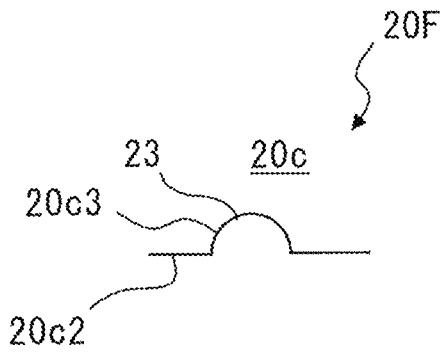
FIG. 25 is a conceptual diagram of the shape of a recess as seen from a direction parallel to a longitudinal direction of the main body (Z-axis direction) according to Embodiment 1 and Embodiment 2.
Figure 26:
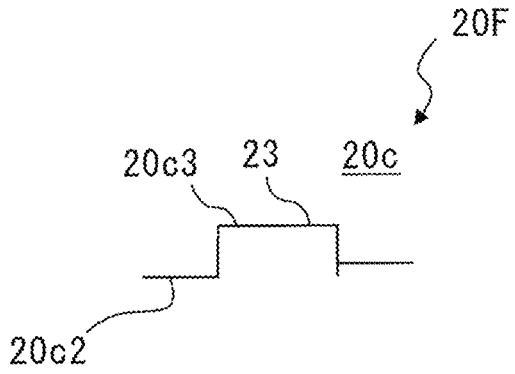
FIG. 26 is a conceptual diagram showing another example of the shape of the recess and is a conceptual diagram showing a first shape.
Figure 27:
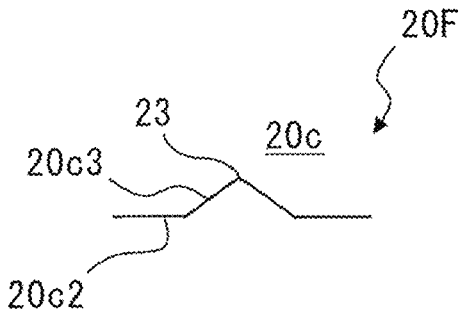
FIG. 27 is a conceptual diagram showing another example of the shape of the recess and is a conceptual diagram showing a second shape.
Figure 28:
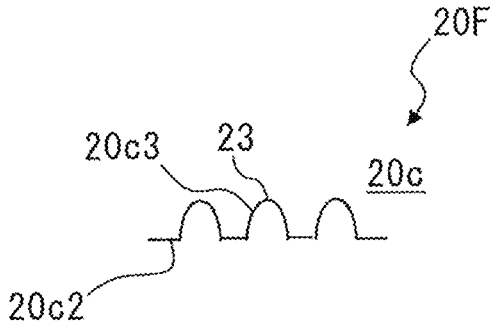
FIG. 28 is a conceptual diagram showing another example of the shape of the recess and is a conceptual diagram showing a third shape.
Figure 29:
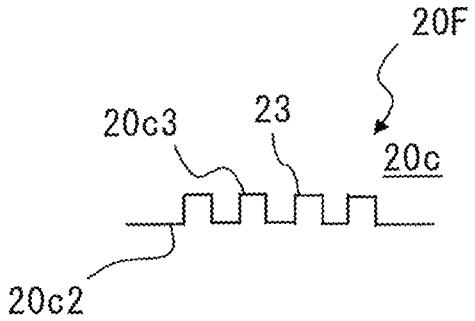
FIG. 29 is a conceptual diagram showing another example of the shape of the recess and is a conceptual diagram showing a fourth shape.
Figure 30:
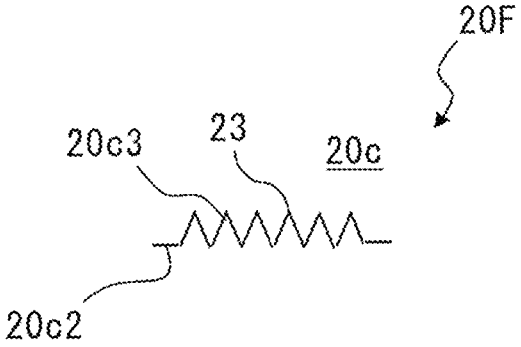
FIG. 30 is a conceptual diagram showing another example of the shape of the recess and is a conceptual diagram showing a fifth shape.

FIG. 25 is a conceptual diagram of the shape of the recess 23 as seen from the direction parallel to the longitudinal direction of the main body 20*a* (Z-axis direction) according to Embodiment 1 and Embodiment 2. FIG. 26 is a conceptual diagram showing another example of the shape of the recess 23 and is a conceptual diagram showing a first shape. FIG. 27 is a conceptual diagram showing another example of the shape of the recess 23 and is a conceptual diagram showing a second shape. FIG. 28 is a conceptual diagram showing another example of the shape of the recess 23 and is a conceptual diagram showing a third shape. FIG. 29 is a conceptual diagram showing another example of the shape of the recess 23 and is a conceptual diagram showing a fourth shape. FIG. 30 is a conceptual diagram showing another example of the shape of the recess 23 and is a conceptual diagram showing a fifth shape. FIG. 25 to FIG. 30 each show a shape of the recess 23 as seen from the direction parallel to the longitudinal direction of the main body 20*a* (Z-axis direction). Other forms of the recess 23 in the columnar part 20*c* of Embodiment 1 or Embodiment 2 will be described using a distributor 20F of Embodiment 3. Those components that have the same function and workings as in the distributor 20 and other distributer according to Embodiment 1 and Embodiment 2 will be denoted by the same reference signs and their description will be omitted.

As shown in FIG. 25, the recess 23 formed in the columnar part 20*c* of the distributor 20 and other distributer according to Embodiment 1 and Embodiment 2 has a semicircular shape. The shape of the recess 23 is not limited to a semicircular shape. The shape of the recess 23 may be a quadrangular shape as shown in FIG. 26 or a triangular shape as shown in FIG. 27. The shape of the recess 23 may include a plurality of semicircular recesses as shown in FIG. 28 or a plurality of quadrangular recesses as shown in FIG. 29. The shape of the recess 23 may have a plurality of triangular recesses as shown in FIG. 30.

The recess 23 is formed such that a cross-section of the recess 23 that is perpendicular to an extension direction of the groove in which the groove extends has any one of a semicircular shape, a quadrangular shape, and a triangular shape, and at least one groove having a cross-section of any one of a semicircular shape, a quadrangular shape, and a triangular shape is formed as the recess 23.

Figure 31:
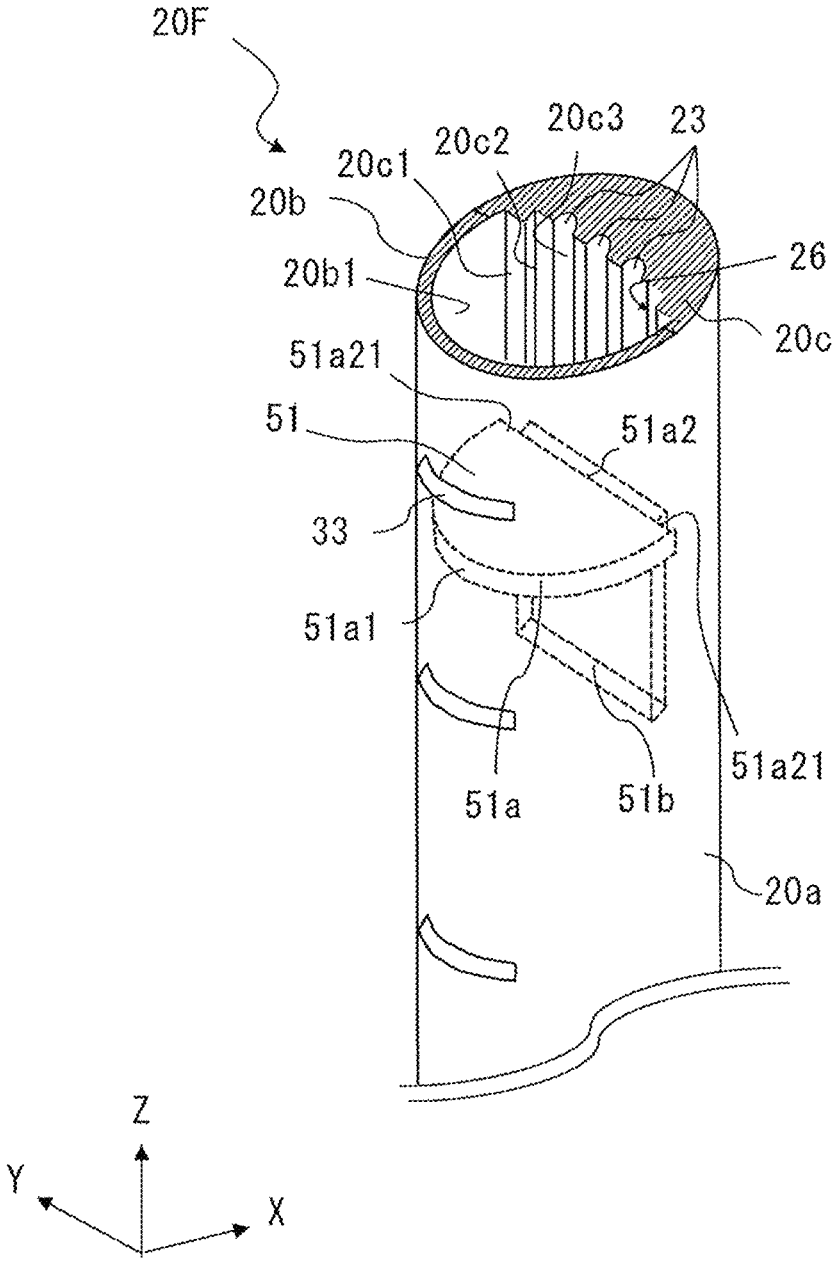
FIG. 31 is a perspective view of a distributor according to Embodiment 3.

FIG. 31 is a perspective view of the distributor 20F according to Embodiment 3. As one example of the distributor 20F according to Embodiment 3, FIG. 31 shows the distributor 20F in a case where the recess 23 shown in FIG. 28 is applied to the distributor 20 according to Embodiment 1.

Unlike the columnar part 20*c* of the distributor 20 according to Embodiment 1, the columnar part 20*c* of the distributor 20F according to Embodiment 3 has the recess 23 for partly forming the second flow passage 27 that is composed of a plurality of recesses. The liquid refrigerant of two-phase gas-liquid refrigerant that flows while rising inside a distributor usually tends to concentrate on the wall surface side inside the distributor while the gas refrigerant of the two-phase gas-liquid refrigerant tends to concentrate on the center side of the cavity inside the distributor. As the recess 23 composed of a plurality of recesses is provided, the distributor 20F according to Embodiment 3 has an increased area of contact between the two-phase gas-liquid refrigerant and the wall surface of the second flow passage 27, Thus, the distributor 20F according to Embodiment 3 is configured to supply a larger amount of liquid refrigerant to an upper part of the distributor 20F than the distributor 20 according to Embodiment 1.

Also even when the recess 23 has a cylindrical shape, a quadrangular shape, a triangular shape or other shape, as seen from the direction parallel to the longitudinal direction of the main body 20*a* (Z-axis direction), the distributor 20F according to Embodiment 3 is configured to supply an increased amount of liquid refrigerant to the upper part of the distributor 20F since the distributor 20F has the recess 23. Thus, similarly to the distributor 20 according to Embodiment 1, the distributor 20F according to Embodiment 3 produces an improving effect on even distribution.

Since the distributor 20F according to Embodiment 3 has the recess 23 of the columnar part 20*c* that is composed of a plurality of recesses, the distributor 20F is configured to supply a further increased amount of liquid refrigerant to the upper part of the distributor 20F owing to the increased length of the perimeter of the recess 23. Thus, the distributor 20F according to Embodiment 3 produces a greater improving effect on even distribution than the distributor 20 according to Embodiment 1.

In a case where the columnar part 20*c* is produced by extrusion, whether the columnar part 20*c* has the shape of the columnar part 20*c* of the distributor 20 according to Embodiment 1 or the shape of the columnar part 20*c* of the distributor 20F according to Embodiment 3 makes little difference in the processability of the columnar part 20*c*. Therefore, similarly to the distributor 20 according to Embodiment 1, the distributor 20F according to Embodiment 3 is inexpensively produced.

Embodiment 4

Figure 32:
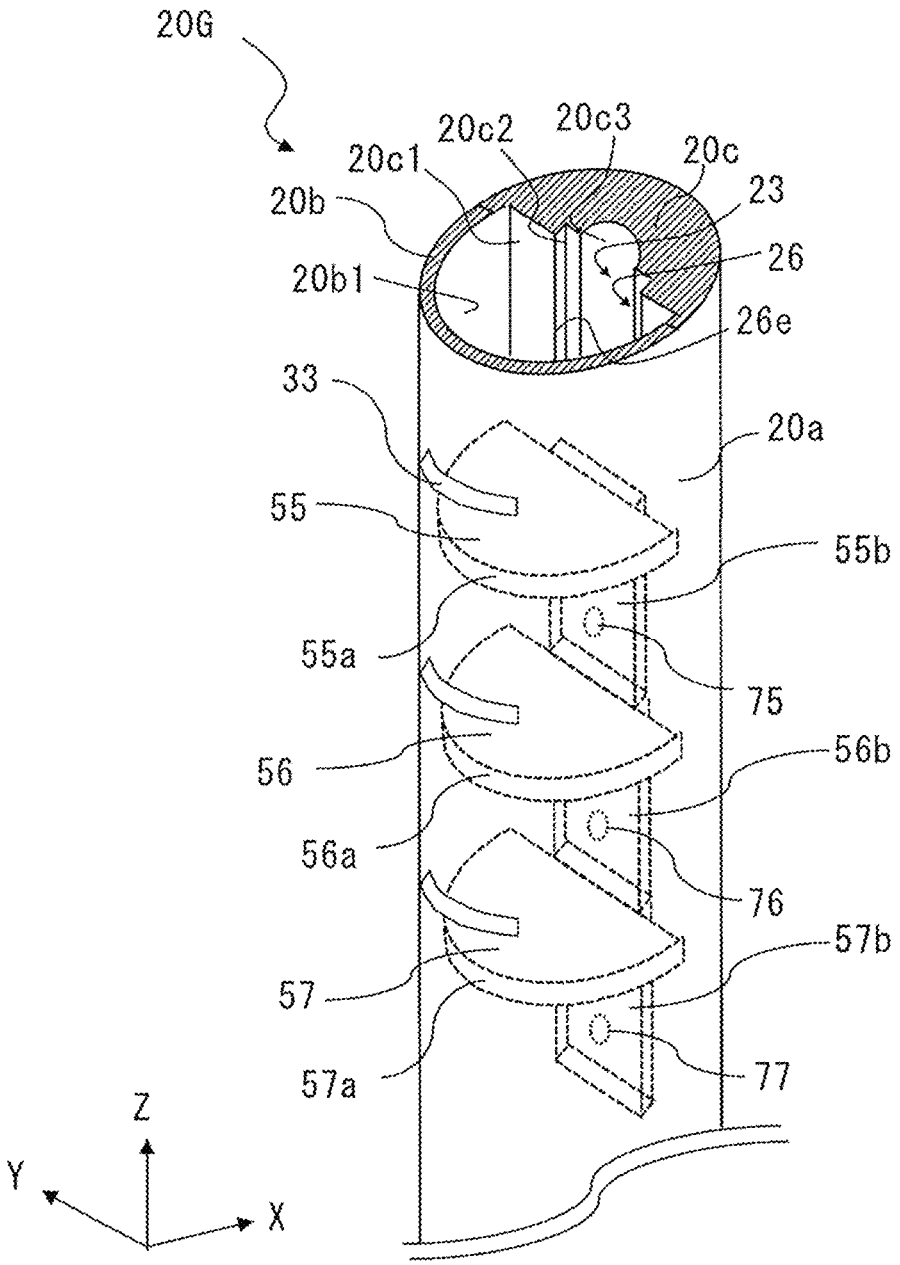
FIG. 32 is a perspective view of a distributor according to Embodiment 4.

FIG. 32 is a perspective view of a distributor 20G according to Embodiment 4. Those components that have the same function and workings as in the distributor 20 and other distributer according to Embodiment 1 to Embodiment 3 will be denoted by the same reference signs and their description will be omitted. In the distributor 20G according to Embodiment 4, the second flow passage 27 partly formed by the insertion part 51 of the distributor 20 according to Embodiment 1 is formed at one location, and yet the number of paths for supplying the two-phase gas-liquid refrigerant to an upper part of the distributor 20E is increased as in the distributor 20E according to Embodiment 2. In the distributor 20G according to Embodiment 4, the structure of an insertion part 55, an insertion part 56, and an insertion part 57 disposed inside the main body 20*a* is partially different from that of the insertion part 51 and the insertion part 52 of the distributor 20 according to Embodiment 1, In the following description, the structures of the insertion part 55, the insertion part 56, and the insertion part 57 will be mainly described.

The distributor 20G has the main body 20*a* formed by the frame-shaped part 20*b* and the columnar part 20*c*. The distributor 20G has the insertion part 55, the insertion part 56, and the insertion part 57 disposed in the internal space of the main body 20*a*. The insertion part 55, the insertion part 56, and the insertion part 57 each have the same basic structure as the insertion part 51 and the insertion part 52.

Specifically, the insertion part 55 has a partition plane 55*a* that contacts the frame-shaped part 20*b* and the columnar part 20*c*, and a flow passage wall 55*b* that contacts the columnar part 20*c*. Similarly, the insertion part 56 has a partition plane 56*a* that contacts the frame-shaped part 20*b* and the columnar part 20*c*, and a flow passage wall 56*b* that contacts the columnar part 20*c*. Similarly, the insertion part 57 has a partition plane 57*a* that contacts the frame-shaped part 20*b* and the columnar part 20*c*, and a flow passage wall 57*b* that contacts the columnar part 20*c*. In the distributor 20G, the partition plane 55*a*, the partition plane 56*a*, and the partition plane 57*a* are first planar parts, and the flow passage wall 55*b*, the flow passage wall 56*b*, and the flow passage wall 57*b* are second planar parts.

The partition plane 55*a*, the partition plane 56*a*, and the partition plane 57*a* each have the same structure as the partition plane 51*a*, Thus, the partition plane 55*a*, the partition plane 56*a*, and the partition plane 57*a* are plate-shaped parts perpendicular to the longitudinal direction of the main body 20*a* (Z-axis direction). As shown in FIG. 32, the partition plane 55*a*, the partition plane 56*a*, and the partition plane 57*a* each having a plate shape form X-Y planes. The partition plane 55*a*, the partition plane 56*a*, and the partition plane 57*a* are each disposed between two of the plurality of connection openings 33, which are made in the longitudinal direction of the frame-shaped part 20*b* (Z-axis direction). Thus, in the longitudinal direction of the main body 20*a* (Z-axis direction), the partition plane 55*a*, the partition plane 56*a*, and the partition plane 57*a* are each disposed between two heat transfer tubes 12, which are inserted through the connection openings 33.

The flow passage wall 55*b*, the flow passage wall 56*b*, and the flow passage wall 57*b* each have the same basic structure as the flow passage wall 51*b*. The flow passage wall 55*b*, the flow passage wall 56*b*, and the flow passage wall 57*b* are plate-shaped parts extending in the longitudinal direction of the main body 20*a* (Z-axis direction). In other words, the flow passage wall 55*b*, the flow passage wall 56*b*, and the flow passage wall 57*b* each have a quadrangular prism shape. As shown in FIG. 32, the flow passage wall 55*b*, the flow passage wall 56*b*, and the flow passage wall 57*b* form a Y-Z plane. The flow passage wall 55*b*, the flow passage wall 56*b*, and the flow passage wall 57*b* are formed to extend downward from the vicinity of the center of the straight part 51*a*2 in the Y-axis direction. The flow passage wall 55*b*, the flow passage wall 56*b*, and the flow passage wall 57*b* are formed at positions facing the groove 26 when the insertion part 55, the insertion part 56, and the insertion part 57 are disposed inside the main body 20*a*.

The insertion part 55, the insertion part 56, and the insertion part 57 are mounted inside the main body 20*a* as the flow passage wall 55*b*, the flow passage wall 56*b*, and the flow passage wall 57*b* are press-fitted into the groove 26. When the insertion part 55, the insertion part 56, and the insertion part 57 are disposed inside the main body 20*a*, the flow passage wall 55*b*, the flow passage wall 56*b*, and the flow passage wall 57*b* are disposed in the groove 26 of the columnar part 20*c* and the space 21*b* is thus defined by the recess 23.

The structure of the flow passage wall 55*b* is different from that of the flow passage wall 51*b* in that a flow passage hole 75 is made in the flow passage wall 55*b*. Thus, the structure of the insertion part 55 is different from that of the insertion part 51 in that the insertion part 55 has the flow passage wall 55*b* in which the flow passage hole 75 is made while the insertion part 51 has the flow passage wall 51*b* in which the flow passage hole 75 is not made. Similarly, the structure of the flow passage wall 56*b* is different from that of the flow passage wall 51*b* in that a flow passage hole 76 is made in the flow passage wall 56*b*. Thus, the structure of the insertion part 56 is different from that of the insertion part 51 in that the insertion part 56 has the flow passage wall 56*b* in which the flow passage hole 76 is made while the insertion part 51 has the flow passage wall 51*b* in which the flow passage hole 76 is not made. Similarly, the structure of the flow passage wall 57*b* is different from that of the flow passage wall 51*b* in that a flow passage hole 77 is made in the flow passage wall 57*b*. Thus, the structure of the insertion part 57 is different from that of the insertion part 51 in that the insertion part 57 has the flow passage wall 57*b* in which the flow passage hole 77 is made while the insertion part 51 has the flow passage wall 51*b* in which the flow passage hole 77 is not made.

The flow passage hole 75, the flow passage hole 76, and the flow passage hole 77 are through-holes, More specifically, the flow passage hole 75, the flow passage hole 76, and the flow passage hole 77 are through-holes that are made across a surface facing the inner wall surface 20*b*1 of the frame-shaped part 20*b* and a surface facing the third inner wall surface 20*c*3. Thus, the flow passage hole 75, the flow passage hole 76, and the flow passage hole 77 are through-holes that are made across a surface facing the first flow passage 25 and a surface facing the second flow passage 27. The flow passage hole 75, the flow passage hole 76, and the flow passage hole 77 provide communication between the first flow passage 25 and the second flow passage 27. In FIG. 32, one flow passage hole 75 is made in the flow passage wall 55*b*, one flow passage hole 76 is made in the flow passage wall 56*b*, and one flow passage hole 77 is made in the flow passage wall 56*b*. However, the number of each of the flow passage holes 75, the flow passage holes 76, and the flow passage holes 77 to be made is not limited to one and at least one each of these flow passage holes is only required to be made.

The flow passage hole 75, the flow passage hole 76, and the flow passage hole 77 each have a circular opening shape in FIG. 32, but the opening shapes of the flow passage hole 75, the flow passage hole 76, and the flow passage hole 77 are not limited. The flow passage hole 75, the flow passage hole 76, and the flow passage hole 77 may be notches. When the flow passage hole 75, the flow passage hole 76, and the flow passage hole 77 are notches, the flow passage hole 75, the flow passage hole 76, and the flow passage hole 77 are made by cutting away a portion of an edge of the flow passage wall 55*b* and other flow passage walls.

In the distributor 20G, the space 21*b* surrounded by the flow passage wall 55*b*, the flow passage wall 56*b*, the flow passage wall 57*b*, and the third inner wall surface 20*c*3 forming the recess 23 of the columnar part 20*c* is defined as the second flow passage 27. The flow passage wall 55*b*, the flow passage wall 56*b*, and the flow passage wall 57*b* of the distributor 20G have the flow passage hole 75, the flow passage hole 76, and the flow passage hole 77. Thus, the distributor 20G creates a flow by which part of the two-phase gas-liquid refrigerant passing through the second flow passage 27 is discharged from the second flow passage 27 to the space of the first flow passage 25.

The distributor 20G according to Embodiment 4 uses the insertion part 55 having the flow passage hole 75, the insertion part 56 having the flow passage hole 76, and the insertion part 57 having the flow passage hole 77. By using three insertion parts each having a flow passage hole, the distributor 20G is configured to supply the two-phase gas-liquid refrigerant from a total of three locations in the recess 23 formed at one location in the columnar part 20*c*. While the distributor 20G uses the three insertion parts, which are the insertion part 55, the insertion part 56, and the insertion part 57, the number of the insertion parts is not limited to three. The number of the insertion parts may be one or two, or four or more. Simply increasing the number of insertion parts having an inflow hole increases the number of paths for supplying the two-phase gas-liquid refrigerant from the second flow passage 27 to the space of the first flow passage 25 in the distributor 20G.

The insertion part 55, the insertion part 56, and the insertion part 57 may all have the same shape. Drilling may be performed at the same time at which the insertion part 55 and other insertion parts are formed by pressing. Therefore, even when the process of making the flow passage hole 75, the flow passage hole 76, and the flow passage hole 77 is required, the production cost of the distributor 20G is equivalent to that of the distributor 20 according to Embodiment 1. Further, in the distributor 20G, purposely making the flow passage hole 75, the flow passage hole 76, and the flow passage hole 77 in the respective insertion part 55, insertion part 56, and insertion part 57 each with a different opening diameter increases or decreases the amount of two-phase gas-liquid refrigerant supplied to a desired heat transfer tube 12. Thus, the distributor 20G is effective when the amounts of air passing through the heat transfer tubes 12 in the heat exchanger 50 are different from each other.

The distributor 20 and other distributer according to Embodiment 4 has the main body 20*a* in which the insertion part 55, the insertion part 56, and the insertion part 57 are disposed. The flow passage wall 55*b*, the flow passage wall 56*b*, and the flow passage wall 57*b*, which are the second planar parts, of the insertion part 55, the insertion part 56, and the insertion part 57 each have at least one flow passage hole that is made as a through-hole and through which the refrigerant passes. Alternatively, the flow passage wall 55*b*, the flow passage wall 56*b*, and the flow passage wall 57*b*, which are the second planar parts, of the insertion part 55, the insertion part 56, and the insertion part 57 each have at least one notch that is cut as a through-hole and through which the refrigerant passes. Thus, in the distributor 20G according to Embodiment 4, a plurality of points for supplying the two-phase gas-liquid refrigerant to the upper part of the distributor 20G are provided by making a flow passage hole in each of the flow passage walls of the insertion parts of one type, Therefore, the distributor 20G according to Embodiment 4 evenly distributes the two-phase gas-liquid refrigerant, or purposely unevenly distributes the two-phase gas-liquid refrigerant, through the use of components that are simpler than the corresponding components of the distributor 20E according to Embodiment 2.

Figure 33:
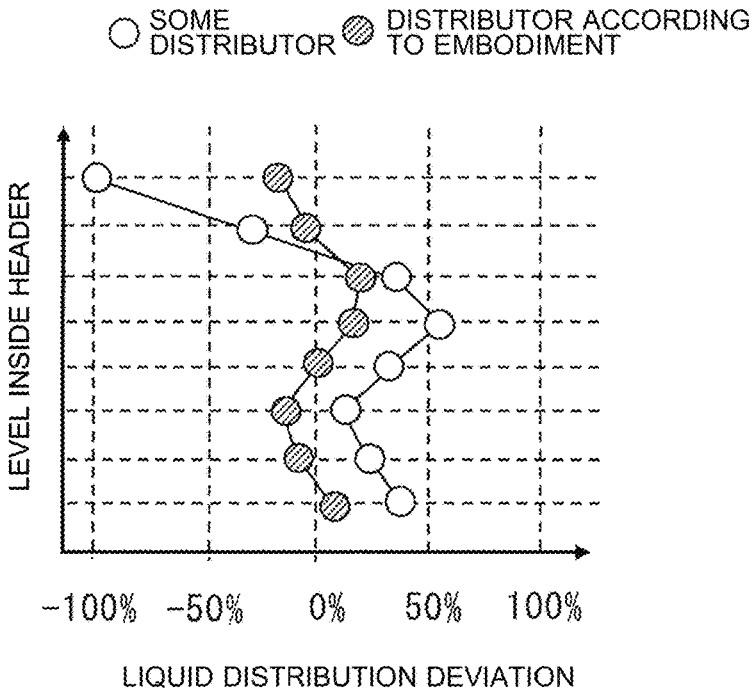
FIG. 33 is a graph of a relationship between the level in the header and a deviation in liquid distribution in a case where an amount of circulation of two-phase gas-liquid refrigerant flowing into the distributor is small.
Figure 34:
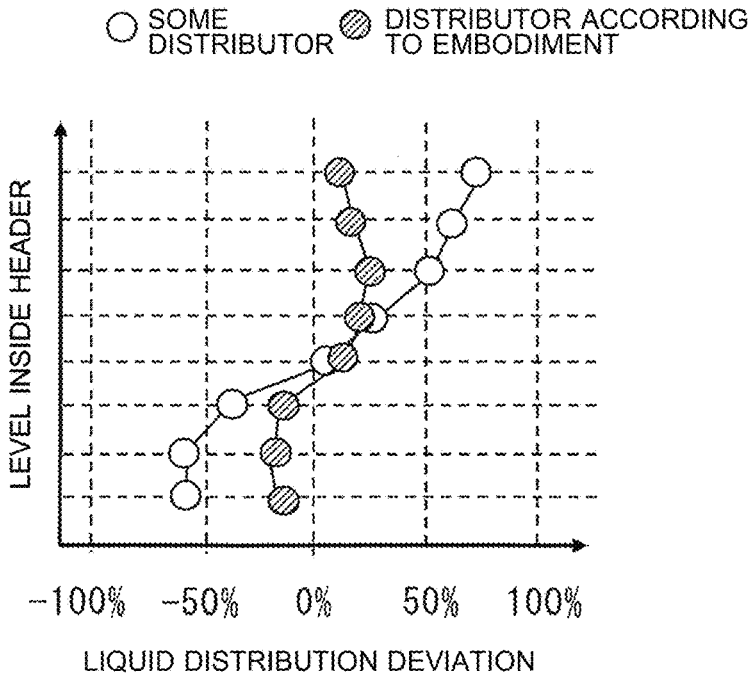
FIG. 34 is a graph of a relationship between the level in the header and the deviation in liquid distribution in a case where the amount of circulation of the two-phase gas-liquid refrigerant flowing into the distributor is large.

FIG. 33 is a graph of a relationship between the level in the header and deviation in liquid distribution in a case where the amount of circulation of the two-phase gas-liquid refrigerant flowing into the distributor 20E is small. FIG. 34 is a graph of a relationship between the level in the header and the deviation in liquid distribution in a case where the amount of circulation of the two-phase gas-liquid refrigerant flowing into the distributor 20E is large. Regarding the distributor 20E using any one of Embodiments 2 to 4, the relationship between the level in the header and the deviation in liquid distribution in the case where at least one of the second flow passage 27 and the third flow passage 28 is used at two locations in the upper part of the distributor 20E will be described as an example with reference to FIG. 33 and FIG. 34.

As shown in FIG. 33, when the amount of circulation of the two-phase gas-liquid refrigerant flowing into the distributor 20E is small, in some distributor, the supply amount of the liquid refrigerant decreases significantly at the two locations in the upper part of the distributor, compared with that at other locations, because the liquid refrigerant separates from the gas refrigerant at the two locations in the upper part of the distributor. In the distributor 20E using any one of Embodiments 2 to 4, by contrast, separation between the liquid refrigerant and the gas refrigerant is prevented by the insertion part 53 or other insertion part. Therefore, even when the amount of circulation of the two-phase gas-liquid refrigerant flowing into the distributor 20E using any one of Embodiments 2 to 4 is small, the distributor 20E is configured to supply the liquid refrigerant in a state of nearly even distribution at all locations in the longitudinal direction of the distributor 20 (Z-axis direction).

As shown in FIG. 34, when the amount of circulation of the two-phase gas-liquid refrigerant flowing into the distributor 20E is large, in some distributor, the amount of liquid refrigerant becomes too large at the upper part of the distributor because of an excessively high flow velocity inside the distributor. Thus, in some distributor, the supply amount of the liquid refrigerant increases significantly at the upper part of the distributor than at other locations. In the distributor 20E or other distributor using any one of Embodiments 2 to 4, the space of the second flow passage 27 or the third flow passage 28 partly defined by the insertion part is small compared with the space of the first flow passage 25. In the distributor 20E or other distributor using any one of Embodiments 2 to 4, therefore, when the amount of circulation of the two-phase gas-liquid refrigerant flowing into the distributor 20E is large, an excessive amount of refrigerant is less likely to be supplied to the upper part of the distributor 20E than in some distributor because of the influence of pressure loss. As a result, the distributor 20E or other distributor using any one of Embodiments 2 to 4 is configured to supply the liquid refrigerant in a state of nearly even distribution at all locations in the longitudinal direction of the distributor 20E (Z-axis direction), even under a condition where the flow velocity inside the distributor 20E is excessively high.

Figure 35:
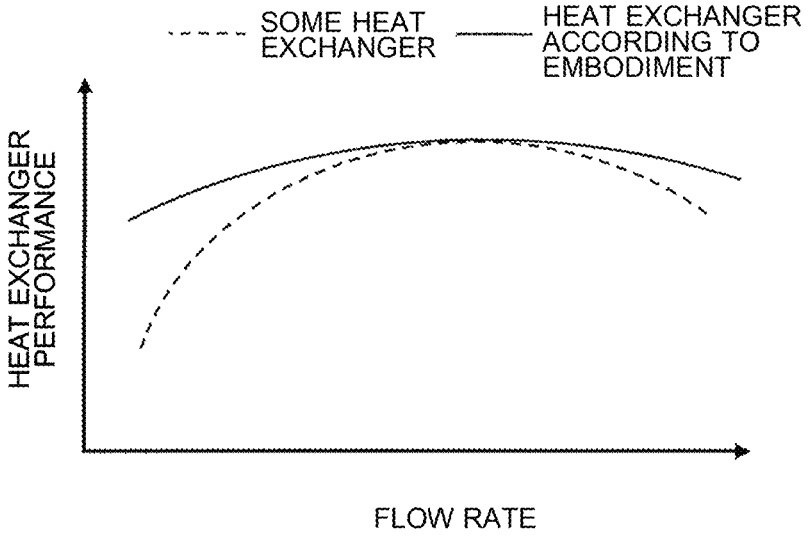
FIG. 35 is a graph of a relationship between a flow rate of the two-phase gas-liquid refrigerant and the performance of a heat exchanger to which the distributor of any one of Embodiments 2 to 4 is applied.

FIG. 35 is a graph of a relationship between the flow rate of the two-phase gas-liquid refrigerant and the performance of the heat exchanger when the distributor 20E or other distributor of any one of Embodiments 2 to 4 is used. As shown in FIG. 33 and FIG. 34, the distributor 20E or other distributor using any one of Embodiments 2 to 4 is configured to supply the liquid refrigerant in a state of nearly even distribution at all locations in the longitudinal direction of the distributor 20 (Z-axis direction). As shown in FIG. 35, therefore, the heat exchanger 50 keeps its performance constant as the heat exchanger 50 is less affected by changes in the flow rate of the two-phase gas-liquid refrigerant than some heat exchanger, and maintains higher performance than some heat exchanger.

Figure 36:
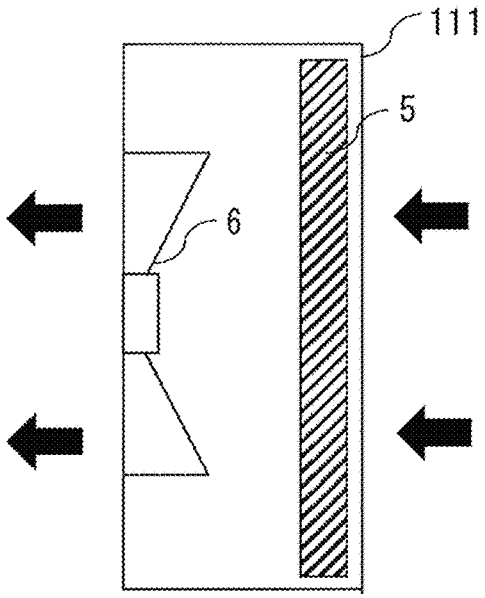
FIG. 36 is a schematic view showing a relationship between a heat exchanger to which the distributor and other distributors according to Embodiments 1 to 4 are applied and an outdoor fan.

FIG. 36 is a schematic view showing a relationship between the heat exchanger 50 to which the distributor 20 and other distributers according to Embodiments 1 to 4 are applied and the outdoor fan 6. The arrows shown in FIG. 36 to FIG. 41 show a flow of air. As shown in FIG. 36, an outdoor unit 111 has the outdoor heat exchanger 5 and the outdoor fan 6. The outdoor unit 111 is used for the refrigeration cycle apparatus 10. The outdoor unit 111 is, for example, an outdoor unit for household use or business use and has the outdoor fan 6 of side-flow type. As the outdoor heat exchanger 5 used for the outdoor unit 111, the above-described heat exchanger 50 is used. Thus, the distributor 20 and other distributers according to Embodiments 1 to 4 are used for the outdoor heat exchanger 5.

Figure 37:
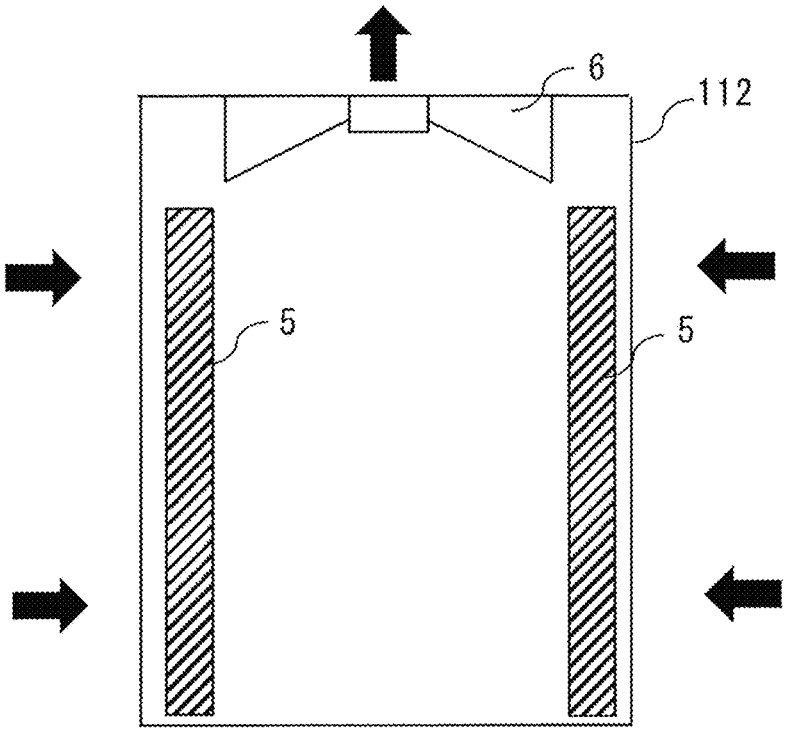
FIG. 37 is a schematic view showing a relationship between heat exchangers to which the distributor and other distributors according to Embodiments 1 to 4 are applied and the outdoor fan.

FIG. 37 is a schematic view showing a relationship between the heat exchangers 50 to which the distributor 20 and other distributers according to Embodiments 1 to 4 are applied and the outdoor fan 6. As shown in FIG. 37, an outdoor unit 112 has the outdoor heat exchangers 5 and the outdoor fan 6. The outdoor unit 112 is used for the refrigeration cycle apparatus 10. The outdoor unit 112 is, for example, an outdoor unit for building use and is equipped with the outdoor fan 6 of top-flow type. As the outdoor heat exchangers 5 used for the outdoor unit 112, the above-described heat exchanger 50 is used. Thus, the distributor 20 and other distributers according to Embodiments 1 to 4 is used for the outdoor heat exchangers 5.

Figure 38:
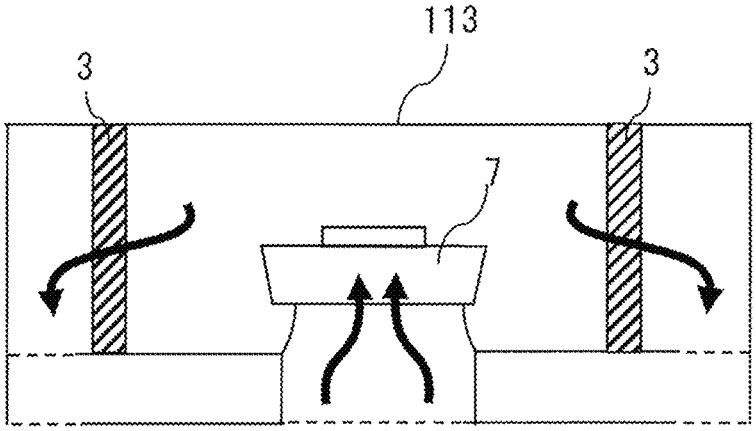
FIG. 38 is a schematic view showing a relationship between heat exchangers to which the distributor and other distributors of Embodiments 1 to 4 are applied and an indoor fan.

FIG. 38 is a schematic view showing a relationship between the heat exchangers 50 to which the distributor 20 and other distributers according to Embodiments 1 to 4 are applied and the indoor fan 7, As shown in FIG. 38, an indoor unit 113 has the indoor heat exchangers 3 and the indoor fan 7. The indoor unit 113 is used for the refrigeration cycle apparatus 10, The indoor unit 113 is, for example, a cassette-type indoor unit for business use and is equipped with a turbofan as the indoor fan 7. As the indoor heat exchangers 3 used for the indoor unit 113, the above-described heat exchanger 50 may be used. Thus, the distributor 20 and other distributers according to Embodiments 1 to 4 may be used for the indoor heat exchanger 3.

Figure 39:
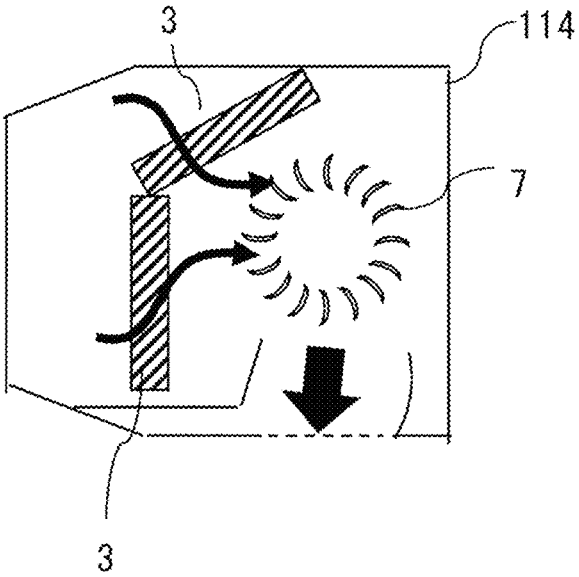
FIG. 39 is a schematic view showing a relationship between heat exchangers to which the distributor and other distributors according to Embodiments 1 to 4 are applied and the indoor fan.

FIG. 39 is a schematic view showing a relationship between the heat exchangers 50 to which the distributor 20 and other distributers according to Embodiments 1 to 4 are applied and the indoor fan 7. As shown in FIG. 39, an indoor unit 114 has the indoor heat exchangers 3 and the indoor fan 7. The indoor unit 114 is used for the refrigeration cycle apparatus 10. The indoor unit 114 is, for example, an indoor unit for household use and is equipped with a line flow fan as the indoor fan 7. As the indoor heat exchangers 3 used for the indoor unit 114, the above-described heat exchanger 50 may be used. Thus, the distributor 20 and other distributers according to Embodiments 1 to 4 may be used for the indoor heat exchanger 3.

Figure 40:
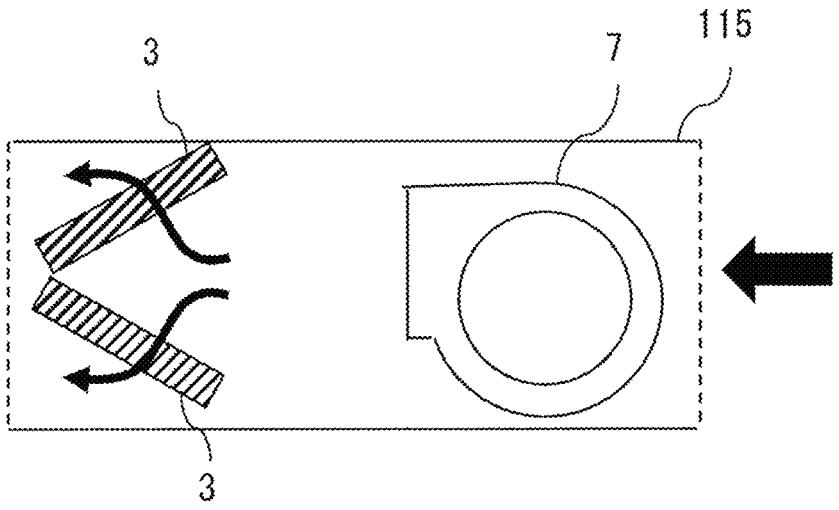
FIG. 40 is a schematic view showing a relationship between heat exchangers to which the distributor and other distributors according to Embodiments 1 to 4 are applied and the indoor fan.
Figure 41:
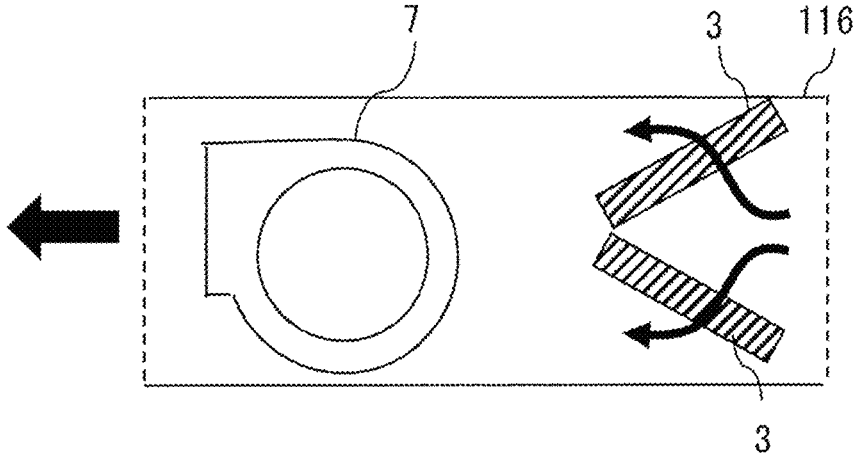
FIG. 41 is a schematic view showing a relationship between other heat exchangers to which the distributor and other distributors according to Embodiments 1 to 4 are applied and the indoor fan.

FIG. 40 is a schematic view showing a relationship between the heat exchangers 50 to which the distributor 20 and other distributers according to Embodiments 1 to 4 are applied and the indoor fan 7. FIG. 41 is a schematic view showing a relationship between other heat exchangers 50 to which the distributor 20 and other distributers according to Embodiments 1 to 4 are applied and the indoor fan 7. As shown in FIG. 40 and FIG. 41, an indoor unit 115 and an indoor unit 116 each have the indoor heat exchangers 3 and the indoor fan 7, In the indoor unit 115, the indoor fan 7 is disposed upstream of the indoor heat exchangers 3 and the indoor heat exchangers 3 are disposed downstream of the indoor fan 7 in the direction of an airflow generated by the indoor fan 7. In the indoor unit 116, the indoor fan 7 is disposed downstream of the indoor heat exchangers 3 and the indoor heat exchangers 3 are disposed upstream of the indoor fan 7 in the direction of an airflow generated by the indoor fan 7, The indoor unit 115 and the indoor unit 116 are used for the refrigeration cycle apparatus 10. The indoor unit 115 and the indoor unit 116 are, for example, ceiling-concealed indoor units and are each equipped with a sirocco fan as the indoor fan 7. As the indoor heat exchangers 3 used for the indoor unit 115 and the indoor unit 116, the above-described heat exchanger 50 may be used. Thus, the distributor 20 and other distributers according to Embodiments 1 to 4 may be used for the indoor heat exchanger 3.

When the indoor heat exchanger 3 is installed at an angle to the direction of gravity as in FIG. 39, FIG. 40, and FIG. 41, falling of the liquid refrigerant due to separation between liquid and gas, which is regarded as a problem, is not very likely to occur. However, the distributor 20 and other distributers according to Embodiments 1 to 4 may be used for the heat exchanger 50 that is installed at an angle to the direction of gravity, to avoid supplying an excessive amount of liquid to the upper part of the distributor 20 or other distributor to which the flow rate is excessively high.

The refrigeration cycle apparatus 10, which is an air-conditioning apparatus, includes the heat exchanger 50 according to any one of Embodiments 1 to 4.

Therefore, the air-conditioning apparatus produces the same effects as any one of Embodiments 1 to 4.

Embodiments 1 to 4 described above are implemented in combinations. The configurations shown in the above embodiments show examples of the contents of the present disclosure. These configurations may be combined with other commonly known techniques, or be partially omitted or changed within a range within which such resultant configurations do not depart from the gist of the present disclosure. For example, the distributor 20 and other distributers according to Embodiments 1 to 4 may be of a vertical type with the main body 20*a* extending in the vertical direction or of a horizontal type with the main body 20*a* extending in the horizontal direction. Alternatively, the distributor 20 and other distributers according to Embodiments 1 to 4 may be configured such that the main body 20*a* is inclined to the vertical direction.

REFERENCE SIGNS LIST

1: compressor, 2: flow passage switching device, 3: indoor heat exchanger, 4: depressurization device, 5: outdoor heat exchanger, 6: outdoor fan, 7: indoor fan, 10: refrigeration cycle apparatus, 10A: refrigerant circuit, 11: bifurcated pipe, 12: heat transfer tube, 12*a*: first heat transfer tube, 12*b*: second heat transfer tube, 12*c*: third heat transfer tube, 12*d*: fourth heat transfer tube, 13: heat transfer promotion part, 20: distributor, 20E: distributor, 20F: distributor, 20G: distributor, 20*a*: main body, 20*a*1: upper main body, 20*a*2: lower main body, 20*b*: frame-shaped part, 20*b*1: inner wall surface, 20*c*: columnar part, 20*c*1: inner wall surface, 20*c*2: second inner wall surface, 20*c*3: third inner wall surface, 21: space, 21*a*: space, 21*b*: space, 21*b*1: space, 21*b*2: space, 21*c*: space, 22: space, 22*a*: space, 22*b*: space,

22*c*: space, 23: recess, 23*a*: first recess, 23*b*: second recess, 25: first flow passage, 26: groove, 26*a*: first groove, 26*b*: second groove, 26*e*: side wall, 27: second flow passage, 28: third flow passage, 31: inflow pipe, 32: inflow pipe, 33: connection opening, 34: inflow opening, 41: lid, 42: lid, 50: heat exchanger, 50*a*: heat exchange unit, 50*b*: main heat exchange unit, 50*c*: auxiliary heat exchange unit, 51: insertion part, 51*a*: partition plane, 51*a*1: curved part, 51*a*2: straight part, 51*a*21: contact portion, 51*b*: flow passage wall, 52: insertion part, 53: insertion part, 53*a*: partition plane, 53*a*1: curved part, 53*a*2: straight part, 53*a*21: contact portion, 53*b*: flow passage wall, 53*c*: closing part. 53*c*1: groove closing portion, 53*c*2: recess closing portion, 54: insertion part, 54*a*: partition plane, 54*a*1: curved part, 54*a*2: straight part, 54*a*21: contact portion, 54*b*: flow passage wall, 54*c*: flow passage wall, 55: insertion part, 55*a*: partition plane, 55*b*: flow passage wall, 56: insertion part, 56*a*: partition plane, 56*b*: flow passage wall, 57: insertion part, 57*a*: partition plane, 57*b*: flow passage wall, 61: partition plate, 75: flow passage hole, 76: flow passage hole, 77: flow passage hole, 80: header, 100: pipe, 101: pipe, 102: pipe, 104: depressurization device, 111: outdoor unit, 112: outdoor unit, 113: indoor unit, 114: indoor unit, 115: indoor unit, 116: indoor unit 201 pipe, 202: pipe, 301: outflow pipe

The invention claimed is:

1. A heat exchanger comprising:

a plurality of heat transfer tubes disposed at intervals in an up-down direction; and a distributor configured to distribute refrigerant to the plurality of heat transfer tubes, the distributor having a main body having a first inflow opening through which refrigerant flows in and a first flow passage through which refrigerant flowing in through the first inflow opening flows upward, and at least one insertion part disposed inside the main body, an upper one and a lower one of two arbitrary heat transfer tubes among the plurality of heat transfer tubes arrayed in the up-down direction are referred to as a first heat transfer tube and a second heat transfer tube, respectively, the at least one insertion part being installed between the first heat transfer tube and the second heat transfer tube, the at least one insertion part having a first planar part that faces the first heat transfer tube and the second heat transfer tube, and the at least one insertion part having a second planar part that is formed on an edge of the first planar part and faces a wall surface of the main body, the main body having a second flow passage that is surrounded by the second planar part and the wall surface of the main body and through which refrigerant flowing in through the first inflow opening flows upward, the refrigerant being configured to flow in the second flow passage between an entirety of the second planar part and the wall surface of the main body, refrigerant passing through the first flow passage and the second flow passage flowing through the first heat transfer tube, refrigerant passing through the first flow passage flowing through the second heat transfer tube.

2. The heat exchanger of claim 1, wherein the main body has a plurality of connection openings that are made at intervals in the up-down direction and through which the plurality of heat transfer tubes are inserted, and at least one recess that has a shape of a groove extending in the up-down direction and the at least one recess is formed at a position facing the plurality of connection openings, and the second flow passage is defined by the second planar part and the at least one recess.

3. The heat exchanger of claim 1, wherein the main body has lids that close both ends of the main body in a longitudinal direction and thus define an internal space in the main body.

4. The heat exchanger of claim 1, wherein the first inflow opening is made at a position facing one of the plurality of heat transfer tubes that is located at a lowest part of an internal space of the main body, or the first inflow opening is made at a lower position than the position of the one of the plurality of heat transfer tubes that is located at the lowest part of the internal space of the main body.

5. The heat exchanger of claim 1, wherein the main body has a shape of a tube formed by a combination of a first part into which the plurality of heat transfer tubes are inserted and a second part having the first inflow opening.

6. The heat exchanger of claim 2, wherein the at least one recess comprises a first recess and a second recess that each have a shape of a groove, are formed next to each other, and extend along a longitudinal direction of the main body, and when another upper one and another lower one of another two arbitrary heat transfer tubes, other than the first heat transfer tube and the second heat transfer tube, among the plurality of heat transfer tubes that are located below the first heat transfer tube are referred to as a third heat transfer tube and a fourth heat transfer tube, respectively, the at least one insertion part including a first insertion part installed between the first heat transfer tube and the second heat transfer tube, and a second insertion part installed between the third heat transfer tube and the fourth heat transfer tube, the first insertion part has a first planar part that faces the first heat transfer tube and the second heat transfer tube, and the first insertion part further has a second planar part that faces the wall surface of the main body and defines a space between the second planar part and the second recess that serves as a third flow passage through which refrigerant flowing in through the first inflow opening flows upward, the second insertion part has a first planar part that faces the third heat transfer tube and the fourth heat transfer tube, the second insertion part further has a second planar part that faces the wall surface of the main body and defines a space between the second planar part and the first recess that serves as the second flow passage, and the second insertion part further has a third planar part that is formed parallel to the wall surface of the main body and defines a space between the third planar part and the second recess that serves as the third flow passage, and the main body is configured such that refrigerant passing through the first flow passage and the second flow passage flows through the first heat transfer tube and that refrigerant passing through the first flow passage and the third flow passage flows through the second heat transfer tube.

7. The heat exchanger of claim 2, wherein the at least one recess is formed such that a cross-section of the at least one recess that is perpendicular to an extension direction of the groove in which the groove extends has any one of a semicircular shape, a quadrangular shape, and a triangular shape.

8. The heat exchanger of claim 1, wherein the second planar part includes at least one flow passage hole that is made as a through-hole and through which refrigerant passes, or at least one notch that is cut as a through-hole and through which refrigerant passes.

9. The heat exchanger of claim 1, wherein the first planar part divides a space inside the main body, except for the second flow passage, into a space above the first planar part and a space below the first planar part.

10. The heat exchanger of claim 1, wherein the main body is installed in a state where a central axis of the main body in a longitudinal direction is oriented vertically or where the central axis in the longitudinal direction is inclined within a range within which the central axis in the longitudinal direction has a vertical vector component.

11. An air-conditioning apparatus comprising:

the heat exchanger of claim 1; and a fan configured to supply air to the heat exchanger.

* * * * *